US011200879B2

(12) United States Patent
Arita et al.

(10) Patent No.: US 11,200,879 B2
(45) Date of Patent: Dec. 14, 2021

(54) SOUND CONTROL DEVICE, WEARABLE SOUND DEVICE AND CONTROL METHOD

(71) Applicant: YAMAHA CORPORATION, Hamamatsu (JP)

(72) Inventors: Mitsuki Arita, Hamamatsu (JP); Yukio Tada, Iwata (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/996,186

(22) Filed: Aug. 18, 2020

(65) Prior Publication Data

US 2020/0380946 A1 Dec. 3, 2020

Related U.S. Application Data

(63) Continuation of application No. PCT/JP2018/006807, filed on Feb. 23, 2018.

(51) Int. Cl.
*G10K 11/178* (2006.01)
*G08B 7/06* (2006.01)
*H04R 1/10* (2006.01)

(52) U.S. Cl.
CPC ..... *G10K 11/178* (2013.01); *G08B 7/06* (2013.01); *H04R 1/10* (2013.01)

(58) Field of Classification Search
CPC ..... G10K 11/178; G10K 11/17857; G10K 11/17885; G10K 11/17873;
(Continued)

(56) References Cited

U.S. PATENT DOCUMENTS 8,340,319 B2 12/2012 Kinouchi
2009/0147969 A1* 6/2009 Kinouchi ..... G10K 11/17821 381/94.7

(Continued)

FOREIGN PATENT DOCUMENTS

CN 102126466 A 7/2011
CN 104822103 A 8/2015

(Continued)

OTHER PUBLICATIONS

International Search Report issued in Intl. Appln. No. PCT/JP2018/006807 dated May 1, 2018. English translation provided.

(Continued)

*Primary Examiner* — Yogeshkumar Patel
(74) *Attorney, Agent, or Firm* — Rossi, Kimms & McDowell LLP

(57) ABSTRACT

A sound control device includes: a first memory storing instructions; and a processor that implements the stored instructions to execute a plurality of instructions, including: a synthesizing task that synthesizes a synthesized sound signal from an input sound signal acquired from a sound input device and a reproducing sound signal acquired from a sound reproducing device; an outputting task that outputs alternately between the reproducing sound signal and the synthesized sound signal to a sound emitting device; a notification control task that outputs notifying information for causing a notifying device to notify for a notification period, which is an output period during which the outputting task is outputting the synthesized sound signal to the sound emitting device; and a registering task that registers, in a second memory, duration information specifying the notification period.

14 Claims, 15 Drawing Sheets

(58) Field of Classification Search
CPC .. G10K 2210/1081; H04R 1/104; H04R 1/10; H04R 1/1083; H04R 1/1008; H04R 1/1016; H04R 5/033; H04R 2201/107; H04R 2410/05; H04R 2420/01; H04R 2420/07; H04R 2499/11; G08B 7/06
See application file for complete search history.

(56) References Cited

U.S. PATENT DOCUMENTS

2011/0046954 A1* 2/2011 Lin ..... H04R 27/00 704/258
2014/0072154 A1* 3/2014 Tachibana ..... H04R 5/033 381/309
2014/0126733 A1* 5/2014 Gauger, Jr. ..... G10K 11/17821 381/71.6
2014/0126756 A1 5/2014 Gauger, Jr.
2015/0170645 A1* 6/2015 Di Censo ..... G10K 11/1783 704/275

FOREIGN PATENT DOCUMENTS

JP 2009147410 A 7/2009
JP 2015537466 A 12/2015
JP 2016500994 A 1/2016

OTHER PUBLICATIONS

Written Opinion issued in Intl. Appln. No. PCT/JP2018/006807 dated May 1, 2018.
English translation of Written Opinion issued in Intl. Appln. No. PCT/JP2018/006807 dated May 1, 2018, previously cited in IDS filed Aug. 18, 2020.
Office Action issued in Chinese Appln. No. 201880088696.4 dated Jul. 30, 2021. English translation provided.

* cited by examiner

SOUND CONTROL DEVICE, WEARABLE SOUND DEVICE AND CONTROL METHOD

CROSS-REFERENCE TO RELATED APPLICATIONS

This application is a U.S. continuation application filed under 35 U.S.C. § 111(a), of International Application No. PCT/JP2018/006807, filed on Feb. 23, 2018, the disclosures of which are incorporated by reference.

FIELD

The present disclosure relates to a technology with which to notify a usage state of a sound emitting device.

BACKGROUND

There are an increasing number of examples in which a sound emitting device, such as headphones or earphones, that is worn over the ears for use is provided with a so-called hear-through function (see, for example, Japanese Laid-open Patent Publication No. 2016-500994). The hear-through function is a function with which to pick up an external sound through a microphone, synthesize the external sound and a reproduced sound, and output the synthesized sound. When a reproduced sound is listened to with such a sound emitting device worn over the ears, an external sound is hardly heard in a case in which the hear-through function is not used. Meanwhile, for example, in the case of a conversation with another person, using the hear-through function can make the conversational partner's voice heard even with a sound emitting device worn over the ears.

SUMMARY

According to one embodiment of the present disclosure, a first memory storing instructions; and a processor that implements the stored instructions to execute a plurality of instructions, including: a synthesizing task that synthesizes a synthesized sound signal from an input sound signal acquired from a sound input device and a reproducing sound signal acquired from a sound reproducing device; an outputting task that outputs alternately between the reproducing sound signal and the synthesized sound signal to a sound emitting device; a notification control task that outputs notifying information for causing a notifying device to notify for a notification period, which is an output period during which the outputting task is outputting the synthesized sound signal to the sound emitting device; and a registering task that registers, in a second memory, duration information specifying the notification period is provided.

According to one embodiment of the present disclosure, a wearable sound device including: a wearable component configured to be worn over an ear and including a sound emitting device; a notifying device disposed in an externally viewable place in a state where the wearable component is held over the ear; a first memory storing instructions; and a processor that implements the stored instructions to execute a plurality of tasks, including: a synthesizing task that synthesizes a synthesized sound signal from an input sound signal acquired from a sound input device and a reproducing sound signal acquired from a sound reproducing device; an outputting task that outputs alternately between the reproducing sound signal and the synthesized sound signal to the sound emitting device; a notification control task that outputs notifying information for causing the notifying device to notify for a notification period, which is an output period during which the outputting task is outputting the synthesized sound signal to the sound emitting device; and a registering task that registers, in a second memory, duration information specifying the notification period is provided.

According to one embodiment of the present disclosure, a control method of controlling a sound control device including: outputting a reproducing sound signal acquired from a sound reproducing device to a sound emitting device; switching outputting of the reproducing sound signal to the sound emitting device to outputting a synthesized sound signal to the sound emitting device, the synthesized sound signal being synthesized from an input sound signal acquired from a sound input device and the reproducing sound signal; outputting notifying information for causing a notifying device to notify for a notification period, which is an output period during which the synthesized sound signal is output to the sound emitting device; and registering, in a second memory, duration information specifying the notification period is provided.

DESCRIPTION OF EMBODIMENTS

Figure 1:
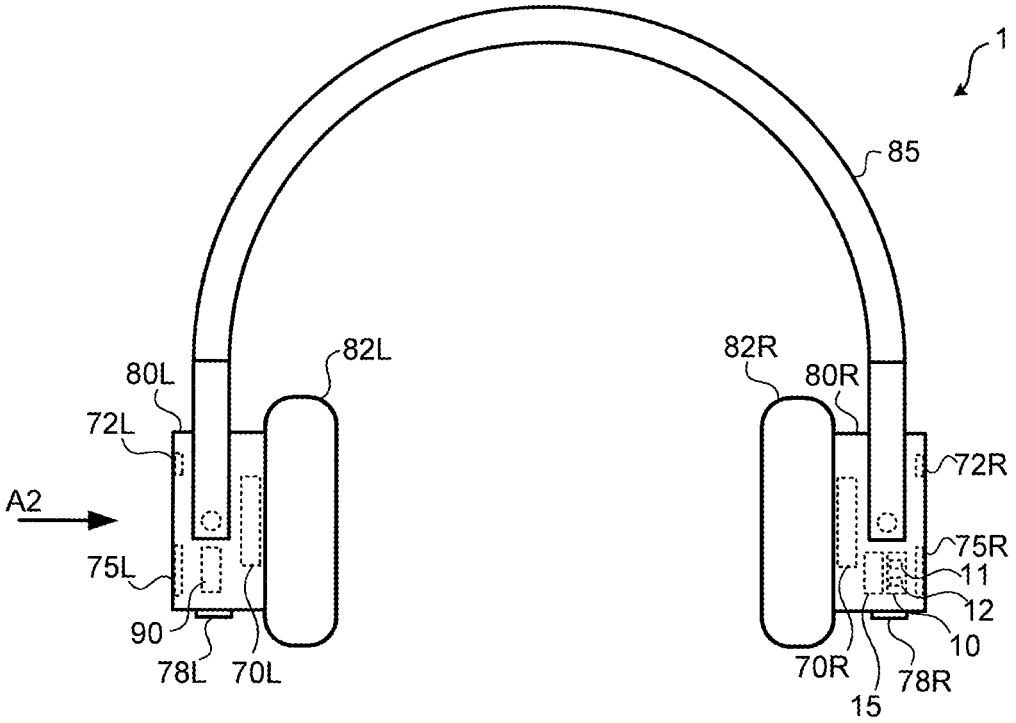
FIG. 1 is a diagram illustrating a configuration of headphones according to a first embodiment of the present disclosure.

In the following, a wearable sound device, such as headphones according to an embodiment of the present disclosure, and a system including a wearable sound device are described in detail with reference to the drawings. Embodiments to be described below are examples of embodiments of the present disclosure, and the present disclosure is not construed within the limitations of these embodiments. It should be noted that in the drawings that are referred to in the present embodiment, identical parts or parts having the same functions are given identical signs or similar signs (signs each formed simply by adding A, B, or the like to the end of a number) and a repeated description thereof may be omitted.

First Embodiment

1. Brief Overview

Headphones according to a first embodiment of the present disclosure can be not only driven in a mode (hereinafter referred to as "reproduced sound mode") in which to output a reproduced sound through a speaker but also driven in a mode (hereinafter referred to as "synthetic sound mode") in which to realize a so-called hear-through function by picking up an external sound, synthesizing the external sound and a reproduced sound, and output the synthesized sound. In this example, these two operation modes can be switched between by a user's operation. Conventionally, other people have been unable to check whether a user wearing a wearable sound device is in a situation where the user can listen to an external sound through the use of the hear-through function or the user is listening to only a reproduced sound without using this function. The headphones are configured to, when driven in the synthetic sound mode, make it possible to check from outside that the headphones are in the operation mode. The following describes a configuration of the headphones according to the first embodiment.

2. Hardware Configuration of Headphones

FIG. 1 is a diagram illustrating a configuration of headphones 1 according to the first embodiment of the present disclosure. The headphones 1 (wearable sound device) include a left housing 80L, a right housing 80R, a left earmuff 82L, a right earmuff 82R, and a headband 85. The headband 85 connects the left housing 80L and the right housing 80R to each other. In this example, the headband 85 electrically connects internal components of the left housing 80L and the right housing 80R to each other inside the headband 85. The left earmuff 82L is attached to the left housing 80L. The right earmuff 82R is attached to the right housing 80R.

In a state where the left earmuff 82L is in contact with the left ear of a user and the right earmuff 82R is in contact with the right ear of the user, the headphones 1 are worn over the ears of the user by the headband 85 applying force in such a manner as to move the left earmuff 82L and the right earmuff 82R closer to each other. In this way, the left housing 80L, the right housing 80R, the left earmuff 82L, the right earmuff 82R, and the headband 85 function as a wearing unit (wearable component) with which for the user to wear the headphones 1 over the user's ears.

The left housing 80L houses an Lch speaker 70L, an Lch microphone 72L, a left LED lamp 75L, and a left operation unit 78L. The right housing 80R houses an Rch speaker 70R, an Rch microphone 72R, a right LED lamp 75R, and a right operation unit 78R. In this example, the right housing 80R houses a control unit 10 (sound control device) and a communication unit 15, and the left housing 80L houses a memory 90. Further, the left housing 80L and the right housing 80R house power supplies 99 (not illustrated), such as secondary batteries, configured to supply electric power to each component.

In the following description, in a case where there is no need for distinction between right and left components, they may be collectively referred to by a generic name. For example, the Lch speaker 70L and the Rch speaker 70R may be collectively referred to as "speaker 70". Similarly, generic names such as "microphone 72", "LED lamp 75", "operation unit 78", "housing 80", and "earmuff 82" may be used.

The speaker 70 (sound emitting device) is disposed at a side of the housing 80 that faces the earmuff 82, converts a supplied electric signal (sound signal) to a sound, and outputs the sound into the air. This causes the sound to reach the ear with which the earmuff 82 is in contact. The microphone 72 (sound input device) is disposed at an outer side of the housing 80 (at the same side as the LED lamp 75), converts an input sound (external sound) to an electric signal (sound signal), and outputs the electric signal. The operation unit 78 is disposed at a surface of the housing 80, accepts a user's operation, converts the user's operation to an electric signal (operation information), and outputs the electric signal. In this example, the operation unit 78 accepts an instruction that designates whether the operation mode of the headphones 1 is the reproduced sound mode or the synthetic sound mode. The operation unit 78 may further accept instructions such as the turning on and off of the power supply, the settings of the output sound volume, and the start and stop of reproduction.

When the headphones 1 are worn over the ears of the user, the LED lamp 75 (notification device) is disposed in an externally viewable place and emits light toward the outside of the housing 80. In this example, when the headphones 1 are worn over the ears of the user, the LED lamp 75 is disposed in a position opposite to the user's ear across the housing 80. In other words, the LED lamp 75 is disposed in a position opposite to the earmuff 82 across the housing 80 (to face in a direction opposite to the direction of sound emission). More specifically, the LED lamp 75 is disposed in the housing 80 so as to emit light having a component oriented in a direction opposite to the direction of sound emission from the speaker 70.

The LED lamp 75 effects a change in appearance of the headphones 1 by effecting a change in form of light emission depending on the operation mode (reproduced sound mode, synthetic sound mode) of the headphones 1. This change is controlled by the control unit 10. A change in appearance of the headphones 1 as seen from the side of the left housing 80L (i.e. as seen from an angle parallel to the direction of an arrow A2) is described with reference to FIG. 2.

Figure 2:
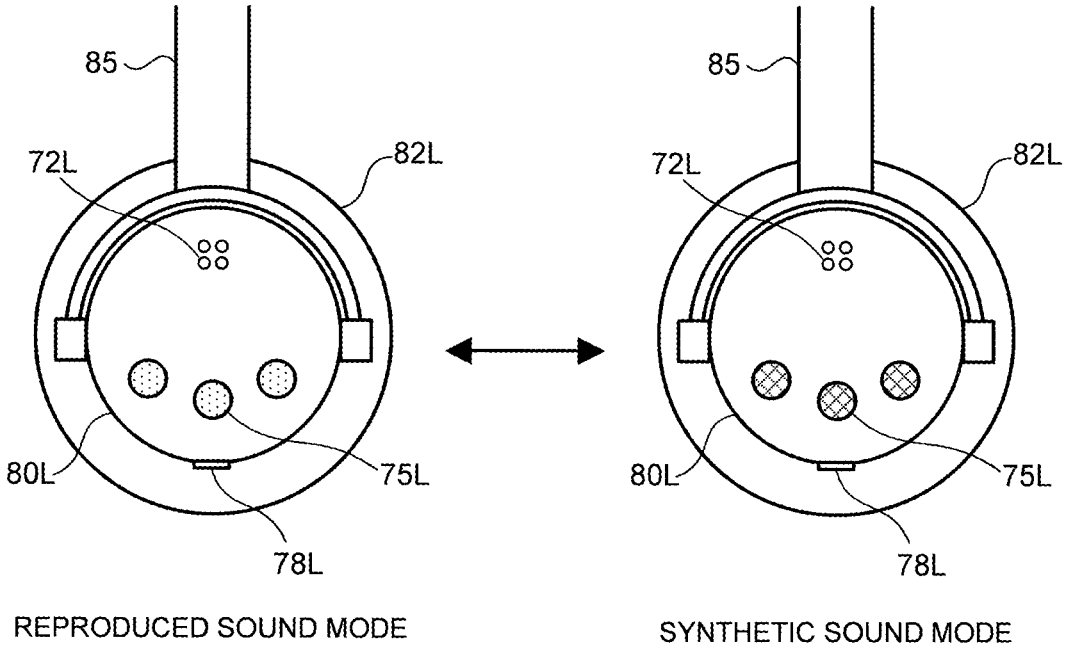
FIG. 2 is a diagram illustrating a change in appearance of the headphones according to the first embodiment of the present disclosure.

FIG. 2 is a diagram illustrating a change in appearance of the headphones 1 according to the first embodiment of the present disclosure. In this example, the left LED lamp 75L is in a light-off state during the reproduced sound mode, and is in a light-on state during the synthetic sound mode. Such a change in appearance is a mere example, and a change needs only be effected depending on which operation mode is being used. For example, patterns of blinking, colors, brightness, the numbers of light emissions may change depending on which operation mode is being used. Although the left LED lamp 75L includes three LED lamps 75L disposed in the left housing 80L, the number may be one or any other number. Further, the LED lamp 75 is not the only component for notifying the operation mode to the outside, but may be replaced by a display device such as an electronic paper, a liquid crystal display, or an organic EL display.

The description goes on with continued reference to FIG. 1. The communication unit 15 is a wireless communication module (e.g. short-range wireless communication such as Bluetooth (registered trademark)), and transmits and receives information to and from an external device under the control of the control unit 10. Alternatively, the communication unit 15 may be a cable communication module.

The memory 90 is a storage medium such as a nonvolatile memory and, in this example, is a medium configured to be removable from the headphones 1 and connectable to another reading device. The memory 90 may be configured to be irremovable from the headphones 1. In this case, for example, an external device reads out, via the communication unit 15, information registered in the memory 90.

The control unit 10 includes an arithmetic processing circuit, such as a CPU 11, and a memory 12. The control unit 10 executes, through the CPU 11, instructions included in a control program stored in the memory 12 and causes the headphones 1 to realize various types of functions. The functions to be realized include a control function. The control program needs only be able to be executed by a computer, and may be provided in a state of being stored in a computer-readable recording medium such as a magnetic storage recording medium, an optical recording medium, a magneto-optical recording medium, or a semiconductor memory. In this example, the headphones 1 need only include a recording medium reading device. Further, the control program may be downloaded via the communication unit 15. The following sequentially describes components through which to realize the control function and a specific method for performing a processing that is executed by the control function.

3. Configuration of Control Function

3. Configuration of Control Function

The control function, which is realized by execution of the control program by the control unit 10 of the headphones 1, is described. Some or all of the components that realize the function to be described below are not limited to being implemented via software but may be implemented via hardware.

Figure 3:
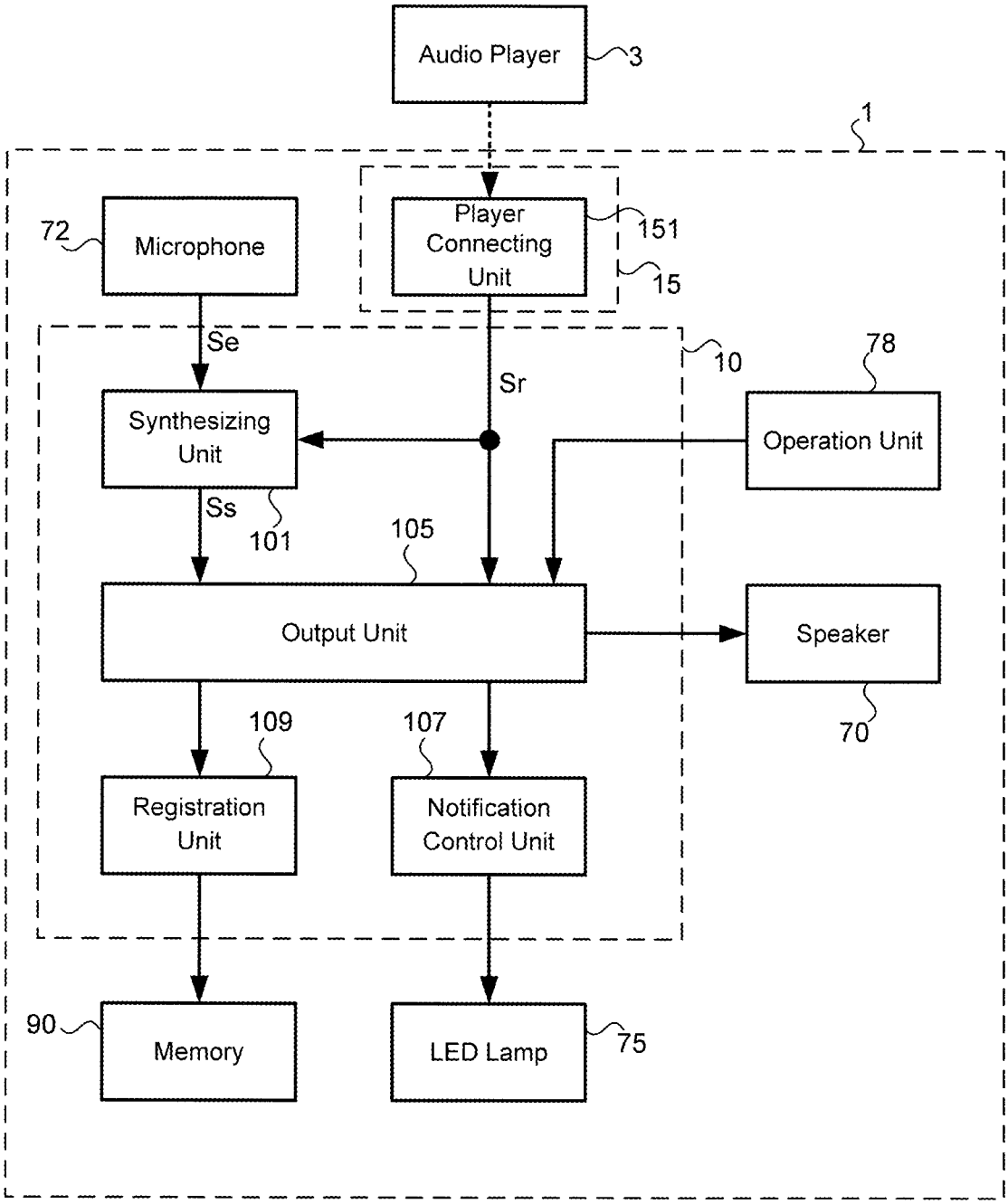
FIG. 3 is a diagram illustrating a configuration of a control function according to the first embodiment of the present disclosure.

FIG. 3 is a diagram illustrating a configuration of the control function according to the first embodiment of the present disclosure. The control unit 10 realizes the control function through a synthesizing unit 101, an output unit 105, a notification control unit 107, and a registration unit 109. Further, in this example, the aforementioned communication unit 15 functions as a player connecting unit 151 that is connected to an audio player 3. The audio player 3 (sound reproducing device) outputs a reproduced sound signal Sr (second sound signal) produced by decoding music data or the like. The player connecting unit 151 receives the reproduced sound signal Sr from the audio player 3 via wireless communication. As mentioned above, the microphone 72 outputs an external sound signal Se (first sound signal) inputted thereto.

The synthesizing unit 101 outputs a sound produced by synthesis of the reproduced sound signal Sr and the external sound signal Se. The term "synthesis" here means addition of the external sound signal Se to the reproduced sound signal Sr. The synthesizing unit 101 outputs a synthetic sound signal Ss (third sound signal) produced by synthesis.

In a case where operation information acquired from the operation unit 78 designates the reproduced sound mode, the output unit 105 outputs the reproduced sound signal Sr to the speaker 70. On the other hand, in a case where the operation information designates the synthetic sound mode, the output unit 105 outputs the synthetic sound signal Ss to the speaker 70. The output unit 105 outputs, to the notification control unit 107 and the registration unit 109, selection information corresponding to the sound signal thus outputted. Instead of the selection information, the operation information from the operation unit 78 may be outputted to the notification control unit 107 and the registration unit 109.

The notification control unit 107 controls the LED lamp 75 in accordance with the selection information. In this example, the notification control 107 turns off the LED lamp 75 in a case where the selection information indicates the reproduced sound mode (that the reproduced sound signal Sr is being outputted). On the other hand, the notification control 107 turns on the LED lamp 75 in a case where the selection information indicates the synthetic sound mode (that the synthetic sound signal Ss is being outputted).

The registration unit 109 registers period information (duration information) in the memory 90 in accordance with the selection information. The period information is information (time information) that specifies a period of time during which the output unit 105 is outputting the synthetic sound signal Ss and, for example, is information indicating a point of time t1 at which the output unit 105 switched from outputting the reproduced sound signal Sr to outputting the synthetic sound signal Ss and a point of time t2 at which the output unit 105 switched from outputting the synthetic sound signal Ss to outputting the reproduced sound signal Sr.

4. Processing by Control Function

The following describes a processing that the control unit 10 executes with the control function. This processing is started by the headphones 1 being powered on.

Figure 4:
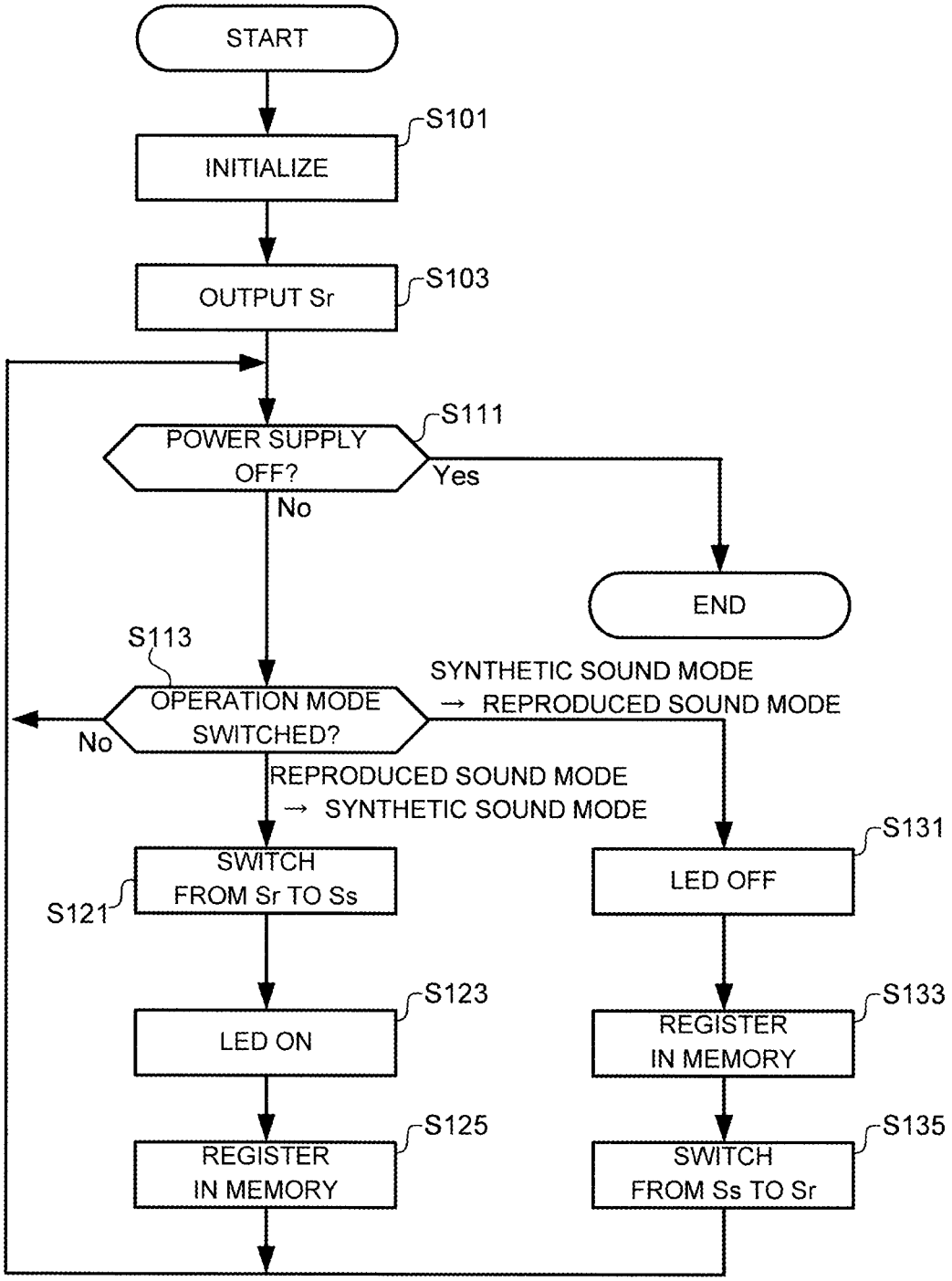
FIG. 4 is a flow chart illustrating a processing that is executed by the control function according to the first embodiment of the present disclosure.

FIG. 4 is a flow chart illustrating a processing that is executed by the control function according to the first embodiment of the present disclosure. First, once this processing is started, the control unit 10 initializes the light-emitting state of the LED lamp 75 and the period information registered in the memory 90 (step S101). By this initialization, the LED lamp 75 is turned off. Further, by the initialization of the period information, the period information registered in the memory 90 is erased. Next, the control unit 10 outputs the reproduced sound signal Sr to the speaker 70 (step S103). That is, the control unit 10 sets the headphones 1 to the reproduced sound mode through the initialization. Alternatively, the control unit 10 may be configured to turn on the LED lamp 75 through the initialization in step S101 and output the synthetic sound signal Ss to the speaker 70 in step S103. That is, the control unit 10 may set the headphones 1 to the synthetic sound mode through the initialization.

Next, the control unit 10 waits for a power-off operation or an operation mode switching operation to be carried out (step S111; No, step S113; No). This state is hereinafter referred to as "waiting state".

When the power supply is turned off in the waiting state (step S111; Yes), the control unit 10 ends the control function. When switching of the operation mode from the reproduced sound mode to the synthetic sound mode takes place in the waiting state (step S113; REPRODUCED SOUND→SYNTHETIC SOUND), the control unit 10 switches from outputting the reproduced sound signal Sr to the speaker 70 to outputting the synthetic sound signal Ss to the speaker 70 (step S121). Next, the control unit 10 turns on the LED lamp 75 (step S123) and registers, in the memory 90, the point of time at which the switching to the synthetic sound mode took place (starting time of the synthetic sound mode) (step S125). After that, the control unit 10 returns to the waiting state.

When switching of the operation mode from the synthetic sound mode to the reproduced sound mode takes place in the waiting state (step S113; SYNTHETIC SOUND→REPRODUCED SOUND), the control unit 10 turns off the LED lamp 75 (step S131) and registers, in the memory 90, the point of time at which the switching to the reproduced sound mode took place (ending time of the synthetic sound mode) (step S133). Next, the control unit 10 switches from outputting the synthetic sound signal Ss to the speaker 70 to outputting the reproduced sound signal Sr to the speaker 70 (step S135). After that, the control unit 10 returns to the waiting state.

The foregoing processing is described with reference to FIG. 5 regarding a specific example of a case where switching from the reproduced sound mode to the synthetic sound mode takes place at a point of time tm1 and then switching to the reproduced sound mode takes place at a point of time tm2.

Figure 5:
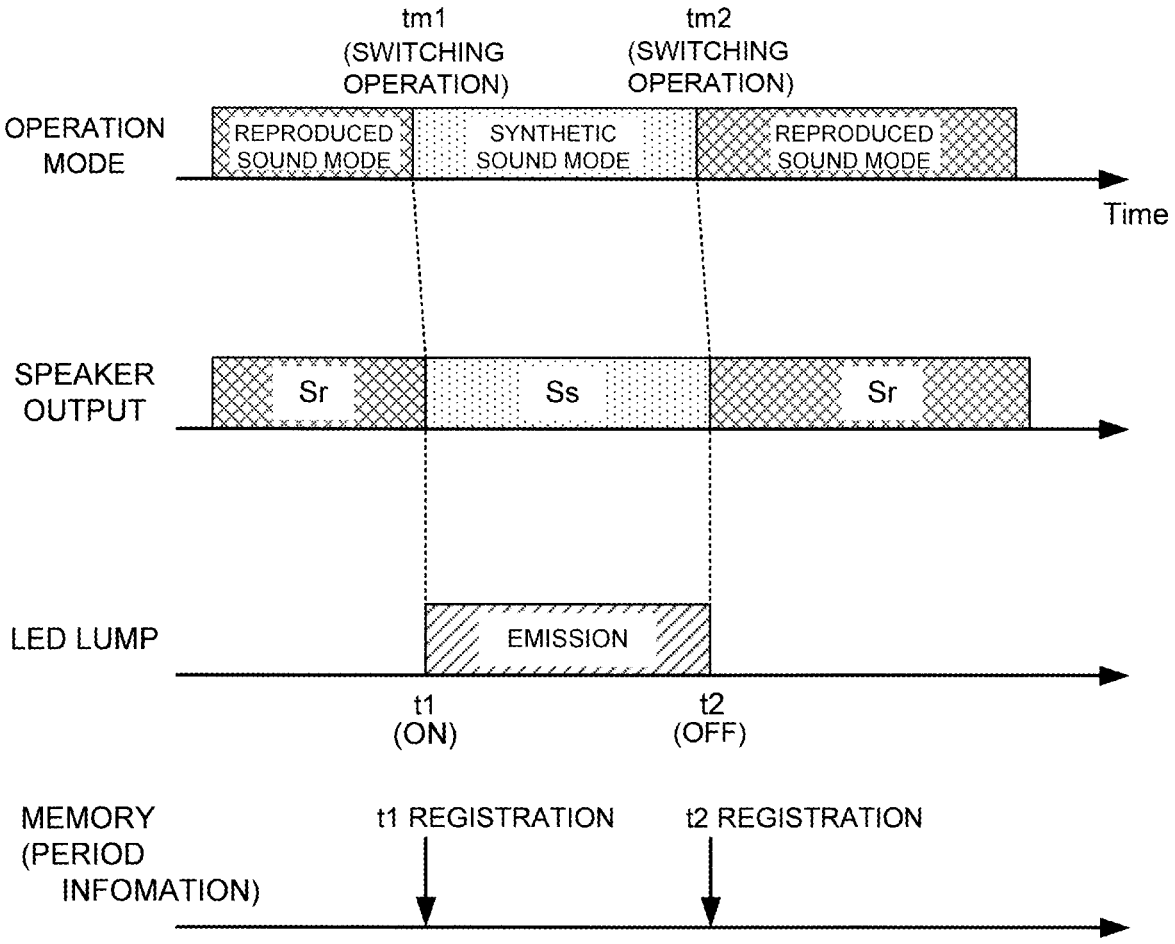
FIG. 5 is a diagram illustrating a specific example of operation mode switching according to the first embodiment of the present disclosure.

FIG. 5 is a diagram illustrating a specific example of operation mode switching according to the first embodiment of the present disclosure. During the reproduced sound mode, the reproduced sound signal Sr is being outputted to the speaker 70. Meanwhile, the LED lamp 75 is in a non-light-emitting state. When switching of the operation mode of the headphones 1 from the reproduced sound mode to the synthetic sound mode takes place at the point of time tm1, switching is made from outputting the reproduced sound signal Sr to the speaker 70 at the point of time t1 to outputting the synthetic sound signal Ss to the speaker 70 at the point of time t1. The point of time t1 may be substantially the same point of time as or lag a predetermined period of time behind the point of time tm1. Further, at the point of time t1, the LED lamp 75 is turned on into a light-emitting state. Furthermore, the point of time t1 is registered as a starting time of the synthetic sound mode in the memory 90.

After that, when switching of the operation mode of the headphones 1 from the synthetic sound mode to the reproduced sound mode takes place at the point of time tm2, switching is made from outputting the synthetic sound signal Ss to the speaker 70 at the point of time t2 to outputting the reproduced sound signal Sr to the speaker 70 at the point of time t2. The point of time t2 may be substantially the same point of time as or lag a predetermined period of time behind the point of time tm2. Further, at the point of time t2, the LED lamp 75 is turned off into a non-light-emitting state. Furthermore, the point of time t2 is registered as an ending time of the synthetic sound mode in the memory 90.

In this way, according to the headphones 1 according to the first embodiment of the present disclosure, the LED lamp 75 is in a light-emitting state during the synthetic sound mode. This makes it possible to check from outside that the operation mode of the headphones 1 is the synthetic sound mode. Further, by registering, in the memory 90, a period of time during which the headphones 1 were in the synthetic sound mode, it can be proven that the headphones 1 was in the synthetic sound mode until just before, even if the headphones 1 are in the reproduced sound mode at the present time. Conversely, it can be proven that the headphones 1 was in the reproduced sound mode until just before, even if the headphones 1 are in the synthetic sound mode at the present time. Such headphones 1 can be used for the following purposes.

5. Examples of Use of Headphones

It is dangerous for a user wearing the headphones 1 over the user's ears to ride a light vehicle such as a bicycle while listening to music in the reproduced sound mode, as it is hard to hear external sounds. Therefore, such actions should be avoided. On the other hand, in a case where the user is listening to music in the synthetic sound mode, a high level of safety is attained even through the user is wearing the headphones 1 over the user's ears, as the user can listen to external sounds and reproduced sounds at the same time.

Even if legal restrictions are imposed on riding a light vehicle while listening to music in the reproduced sound mode, the synthetic sound mode, in which external sounds can be listened to, might be free from such legal restrictions. In such a case, the headphones 1 according to the first embodiment of the present disclosure, which make it possible to, through the emission of light by the LED lamp 75, check from outside that the headphones 1 are in the synthetic sound mode, make it possible to easily visually check whether an action involving the use of the headphones 1 should be subject to such legal restrictions.

Further, the presence of the memory 90 renders the following form of use conceivable. Under such legal restrictions, a user who uses the headphones 1 in the reproduced sound mode may get questioned by a police officer as a target of a crackdown. On this occasion, the user may be exempted from the crackdown by switching to the synthetic sound mode just before getting questioned. Even in such a case, by reading out the period information registered in the memory 90, it can be easily proven that the switching to the synthetic sound mode was made just before. On the other hand, the user may be mistakenly placed under the crackdown by the police officer even through the user has been using the headphones 1 in the synthetic sound mode. Even in such a case, by reading out the period information registered in the memory 90, it can be easily proven that the headphones 1 have been in the synthetic sound mode for some time.

Second Embodiment

In the first embodiment, the operation mode of the headphones 1 is checked from outside by checking the light-emitting state of the LED lamp 75. A second embodiment illustrates headphones 1A including a component for checking the operation mode at an external terminal. In this example, the terminal at which the operation mode of the headphones 1A can be checked is referred to as "notification terminal 5". Thus, in the second embodiment, notification of the operation mode (particularly the synthetic sound mode) is not executed by the emission of light by the LED lamp 75 but executed as a display on the notification terminal 5

(notification unit). The following describes a configuration of the headphones 1A and the notification terminal 5 according to the second embodiment.

Figure 6:
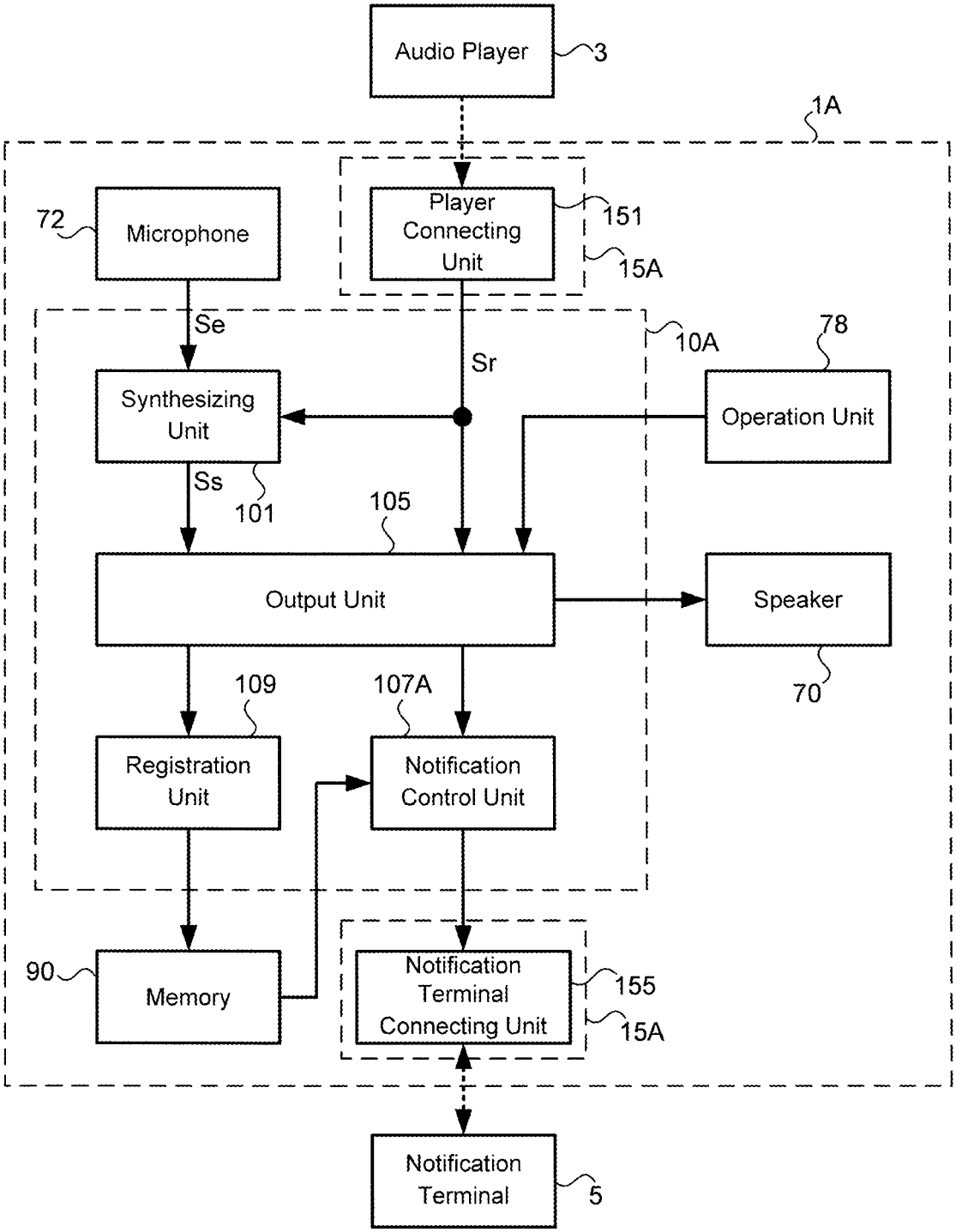
FIG. 6 is a diagram illustrating a configuration of a control function according to a second embodiment of the present disclosure.

FIG. 6 is a diagram illustrating a configuration of a control function according to the second embodiment of the present disclosure. The headphones 1A include a control unit 10A, a communication unit 15A, the speaker 70, the microphone 72, the operation unit 78, and the memory 90. The control unit 10A realizes the control function through the synthesizing unit 101, the output unit 105, a notification control unit 107A, and the registration unit 109. In addition to functioning as the player connecting unit 151, the communication unit 15A also functions as a notification terminal connecting unit 155 that is connected to the notification terminal 5. Meanwhile in this example, the headphones 1A do not include the LED lamp 75. Other components given the same reference signs as those of the first embodiment have the same functions as those of the first embodiment. Accordingly, a description of those functions is omitted. In this example, the audio player 3 and the notification terminal 5 are separate devices, but may be integrated into one device.

The notification control unit 107A outputs information pertaining to the operation mode of the headphones 1A to the notification terminal connecting unit 155 upon a request from the notification terminal 5 connected to the notification terminal connecting unit 155. In a case where the operation mode of the headphones 1A is the synthetic sound mode, the notification control unit 107A further reads out the period information from the memory 90. The notification control unit 107A calculates a duration time elapsed from the point of time t1 (i.e. the point of time at which switching from the reproduced sound mode to the synthetic sound mode took place) indicated by the period information to the present time, and outputs the duration time to the notification terminal connecting unit 155. These pieces of information (notifying information) are transmitted to the notification terminal 5 via the notification terminal connecting unit 155.

Figure 7:
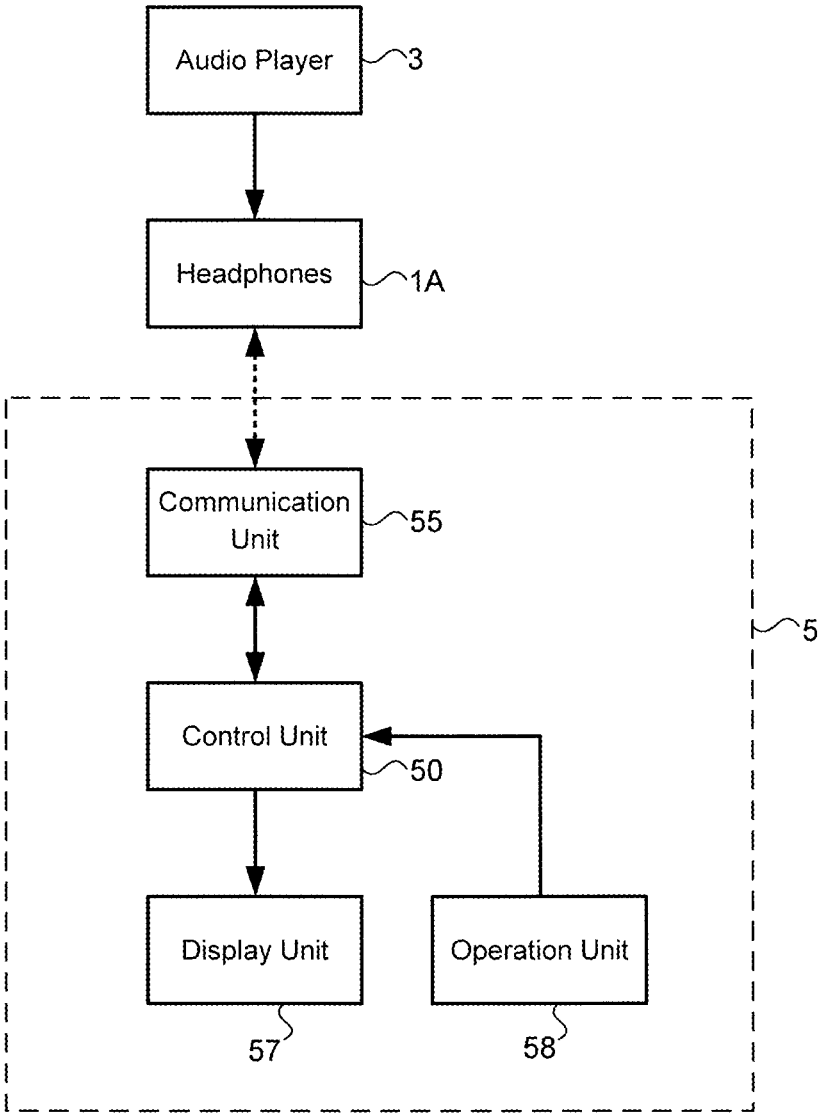
FIG. 7 is a diagram illustrating a configuration of a notification terminal according to the second embodiment of the present disclosure.

FIG. 7 is a diagram illustrating a configuration of the notification terminal 5 according to the second embodiment of the present disclosure. The notification terminal 5 includes a control unit 50, a communication unit 55, a display unit 57, and an operation unit 58. The communication unit 55 is a wireless communication module (e.g. short-range wireless communication such as Bluetooth (registered trademark)), and transmits and receives information to and from an external device under the control of the control unit 50. In this example, the communication unit 55 functions as a headphone connecting unit to which the headphones 1A are connected. The display unit 57 displays a screen under the control of the control unit 50. The operation unit 58 accepts a user's operation, converts the user's operation to an electric signal, and outputs the electric signal. The display unit 57 and the operation unit 58 may constitute a touch panel.

The control unit 50 includes an arithmetic processing circuit, such as a CPU, and a memory. The control unit 50 executes, through the CPU, a control program stored in the memory and causes the notification terminal 5 to realize various types of functions. The functions to be realized include a notification function. The control program needs only be able to be executed by a computer, and may be provided in a state of being stored in a computer-readable recording medium such as a magnetic storage recording medium, an optical recording medium, a magneto-optical recording medium, or a semiconductor memory.

According to the notification function, for example, the following processing is executed. When an instruction to acquire information on the headphones 1A is inputted via the operation unit 58, the control unit 50 sends a connection request to the headphones 1A via the communication unit 55. When the notification terminal 5 receives notification information corresponding to the connection request from the headphones 1A, the control unit 50 causes the display unit 57 to carry out a display (see FIG. 9, which will be described later) corresponding to the notification information.

The following describes a processing that the control unit 10A of the headphones 1A executes with the control function. This processing is started by the headphones 1A being powered on.

Figure 8:
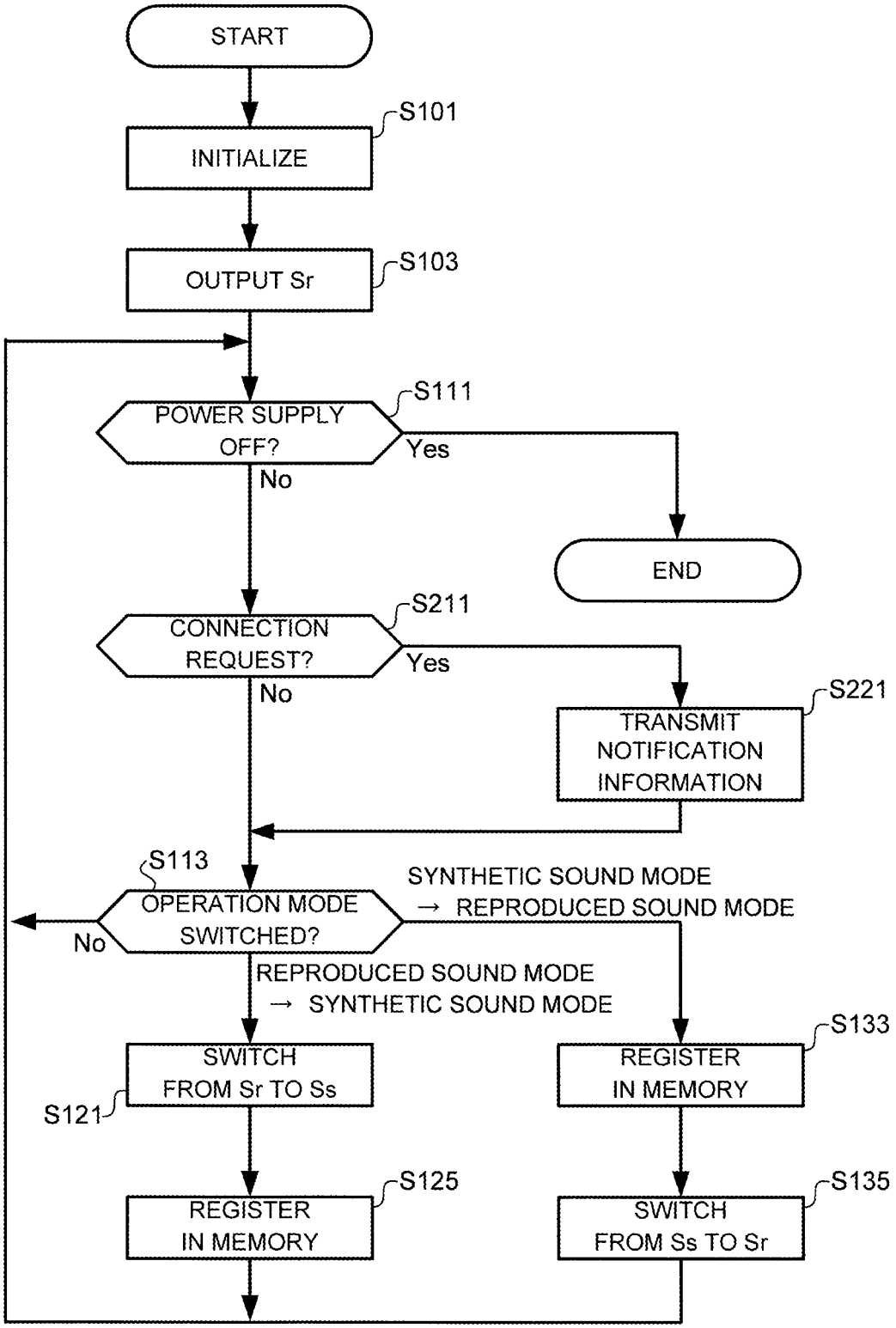
FIG. 8 is a flow chart illustrating a processing that is executed by the control function according to the second embodiment of the present disclosure.

FIG. 8 is a flow chart illustrating a processing that is executed by the control function according to the second embodiment of the present disclosure. Steps which are identical to those of the processing according to the first embodiment shown in FIG. 4 are given the same reference signs. A description of those steps is simplified.

First, once this processing is started, the control unit 10A initializes the period information registered in the memory 90 (step S101) and outputs the reproduced sound signal Sr to the speaker 70 (step S103). Next, the control unit 10A waits for a power-off operation, the reception of a connection request from the notification terminal 5, or an operation mode switching operation to be carried out (step S111; No, step S211; No, step S113; No). This state is hereinafter referred to as "waiting state".

When the power supply is turned off in the waiting state (step S111; Yes), the control unit 10 ends the control function. When switching of the operation mode from the reproduced sound mode to the synthetic sound mode takes place in the waiting state (step S113; REPRODUCED SOUND→SYNTHETIC SOUND), the control unit 10A switches from outputting the reproduced sound signal Sr to the speaker 70 to outputting the synthetic sound signal Ss to the speaker 70 (step S121). Next, the control unit 10A registers, in the memory 90, the point of time at which the switching to the synthetic sound mode took place (starting time of the synthetic sound mode) (step S125). After that, the control unit 10A returns to the waiting state.

When switching of the operation mode from the synthetic sound mode to the reproduced sound mode takes place in the waiting state (step S113; SYNTHETIC SOUND→REPRODUCED SOUND), the control unit 10A registers, in the memory 90, the point of time at which the switching to the reproduced sound mode took place (ending time of the synthetic sound mode) (step S133). Next, the control unit 10A switches from outputting the synthetic sound signal Ss to the speaker 70 to outputting the reproduced sound signal Sr to the speaker 70 (step S135). After that, the control unit 10A returns to the waiting state.

Upon receiving a connection request from the notification terminal 5 (step S211; Yes), the control unit 10A transmits notification information to the notification terminal 5 via the notification terminal connecting unit 155 (step S221). When the notification terminal 5 receives the notification information, the control unit 50 causes the display unit 57 to display a screen corresponding to the notification information.

Figure 9:
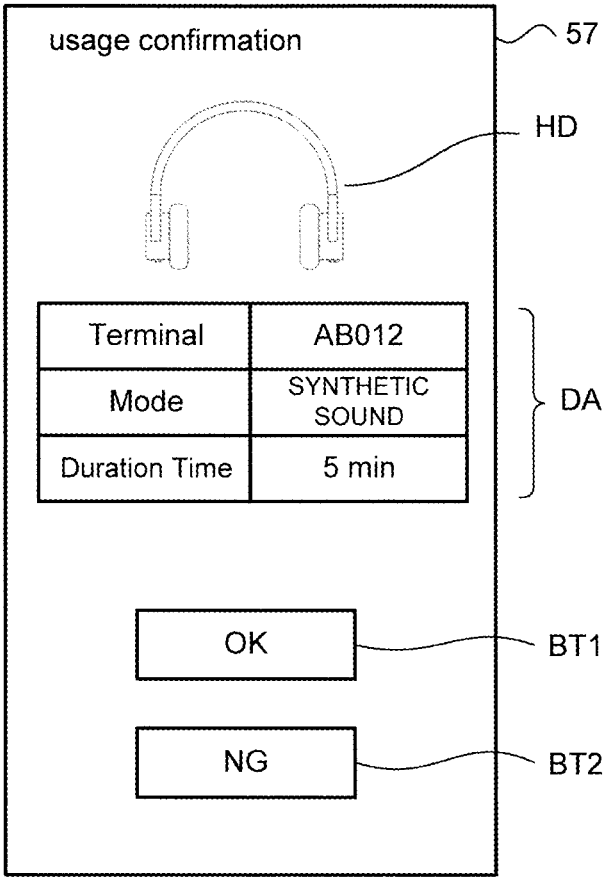
FIG. 9 is a diagram illustrating an example of a screen that is displayed on the notification terminal according to the second embodiment of the present disclosure.

FIG. 9 is a diagram illustrating an example of a screen that is displayed on the notification terminal 5 according to the second embodiment of the present disclosure. As illustrated in FIG. 9, the screen that is displayed on the display unit 57 includes an area DA indicating information on the headphones 1A. Displayed in the area DA are the terminal name (in this example, "AB012") of the headphones 1A, the name (in this example, "synthetic sound mode") of the operation mode, and the duration time (in this example, "5 min") of the synthetic sound mode, which is displayed in the case of the synthetic sound mode. On this occasion, as shown in FIG. 9, an image HD representing a terminal form corresponding to the terminal name may be displayed near the area DA.

Further, buttons BT1 and BT2 with which for a user to input instructions may be displayed near the area DA. In this example, an OK button BT1 and an NG button BT2 are displayed. Operation of the headphones 1A may be controlled at the flick of this button BT1 or BT2. For example, at the flick of the OK button BT1, the headphones 1A is kept continuously usable. On the other hand, at the flick of the NG button BT2, the use of the headphones 1A may be temporarily restricted, or the operation mode may be rendered unchangeable for a certain period of time by forcibly changing the operation mode to the synthetic sound mode.

As described above, the headphones 1A according to the second embodiment use not the LED lamp 75 but the notification terminal 5 to notify the operation mode to the outside. Thus, the component for notifying the operation mode (particularly the synthetic sound mode) to the outside is not limited to a device integrated with the headphones 1A but may be separate devices.

Third Embodiment

While a user switches the operation mode in the first embodiment, a third embodiment illustrates headphones 1B whose operation mode is automatically switched upon the satisfaction of predetermined conditions.

Figure 10:
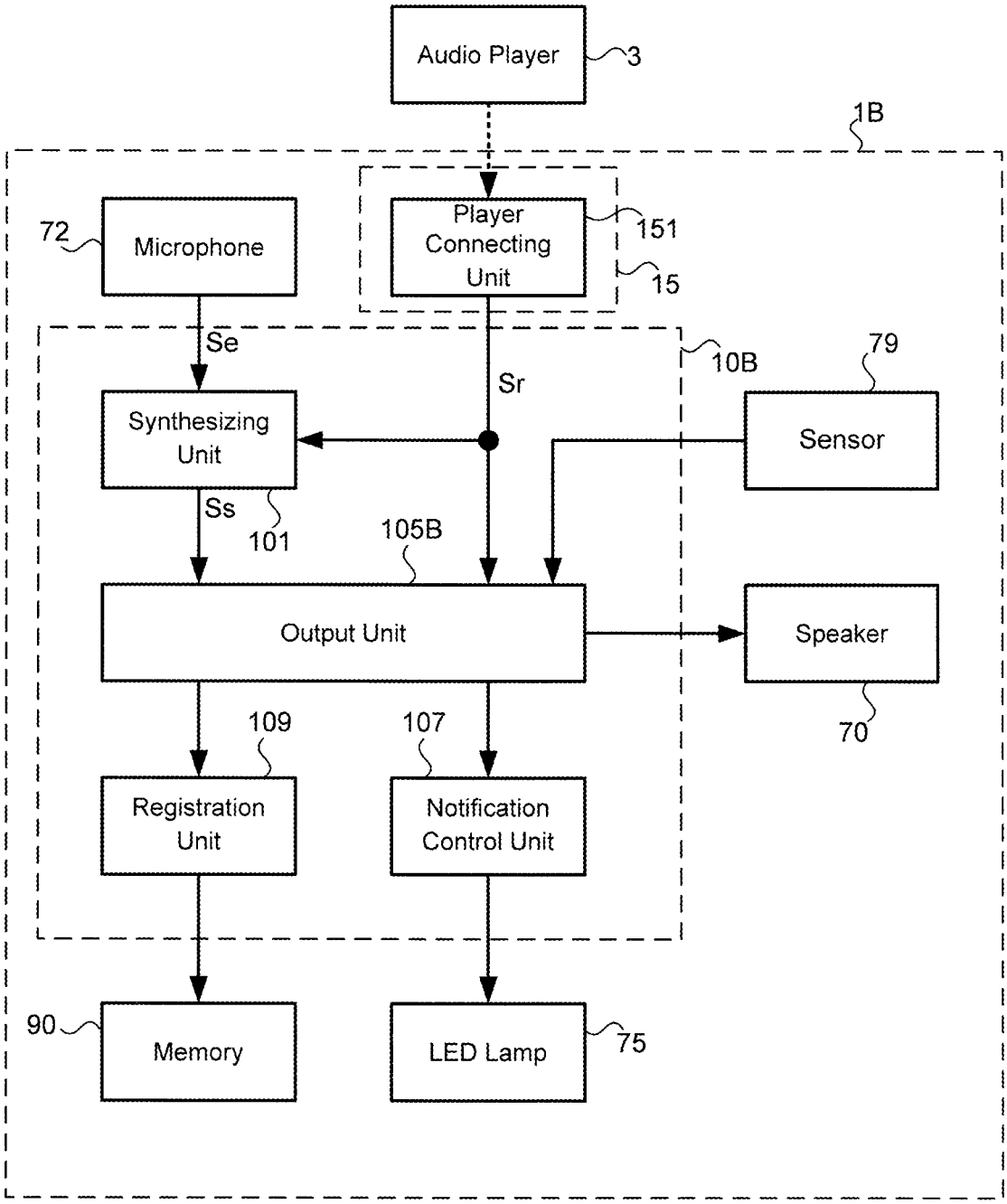
FIG. 10 is a diagram illustrating a configuration of a control function according to a third embodiment of the present disclosure.

FIG. 10 is a diagram illustrating a configuration of a control function according to the third embodiment of the present disclosure. The headphones 1B include a control unit 10B, the communication unit 15, the speaker 70, the microphone 72, the LED lamp 75, a sensor 79, and the memory 90. The control unit 10B realizes the control function through the synthesizing unit 101, an output unit 105B, the notification control unit 107, and the registration unit 109. Other components given the same reference signs as those of the first embodiment have the same functions as those of the first embodiment. Accordingly, a description of those functions is omitted.

In this example, the sensor 79 is a position sensor (positional measurement unit) that measures the position of the headphones 1B, and outputs a measurement signal (e.g. a signal containing information indicating the latitude, the longitude, and the altitude) corresponding to the position. The output unit 105B selects either the reproduced sound signal Sr or the synthetic sound signal Ss based on the measurement signal outputted from the sensor 79, and outputs the sound signal thus selected to the speaker 70. In this example, the output unit 105B calculates the moving speed of the headphones 1B (i.e. the moving speed of a user wearing the headphones 1B) based on the position indicated by the measurement signal. Moreover, when the moving speed is equal to or higher than a predetermined speed (e.g. 5 km/h), the output unit 105B outputs the synthetic sound signal Ss to the speaker 70, and when the moving speed is lower than the predetermined speed, the output unit 105B outputs the reproduced sound signal Sr to the speaker 70.

By so doing, when the moving speed of the user wearing the headphones 1B becomes equal to or higher than the predetermined speed, the operation mode of the headphones 1B is automatically switched from the reproduced sound mode to the synthetic sound mode. Situations (walking, running, riding a bicycle, driving an automobile) in which automatic switching to the synthetic sound mode takes place may change depending on settings of the predetermined speed. Further, in a case where the sensor 79 is a position sensor, the operation mode may be switched depending on whether the position of the headphones 1B falls within a particular range on a map. For example, it is conceivable that a heavily-trafficked place such as an intersection or a place in front of a train station may be set as the particular range. With such a setting, forcible switching to the synthetic sound mode can be made when the user visits a heavily-trafficked place.

The sensor 79 is not limited to a position sensor. For example, the sensor 79 may be a sensor (behavior measurement unit), such as an acceleration sensor or a vibration sensor, for measuring the behavior of the headphones 1B. In this case, the operation mode may be switched depending on behavior indicated by a measurement signal outputted from the sensor 79. For example, in a case where a vibration of the headphones 1B has been sensed (assuming that the user is moving), the operation mode may be switched to the synthetic sound mode.

Alternatively, the sensor 79 may be a sensor, such as an illuminance sensor, for measuring the brightness of an area surrounding the headphones 1B. In this case, the operation mode may be switched depending on brightness indicated by a measurement signal outputted from the sensor 79. For example, when the brightness of the area surrounding the headphones 1B is not higher than a predetermined value (that is, the surrounding area has become dark), the operation mode can be switched to the synthetic sound mode.

Further, the headphones 1B may include a clock instead of or together with the sensor 79. In this case, the operation mode may be switched depending on the time of day. For example, switching to the synthetic sound mode can be made during commuting hours when lots of people come and go. In a case where the aforementioned illuminance sensor is used as the sensor 79 together with the clock, the operation mode may be switched based on a combination of pieces of information obtained from them. For example, in a case where the surrounding area has become bright during nighttime hours (assuming a case where the headlights of a car are turned on during a night drive), switching to the synthetic sound mode can be made.

Fourth Embodiment

In the first embodiment, the control unit 10, which realizes the control function, is provided in the headphones 1. Alternatively, a component that realizes a control function may be provided in a component that is separate from headphones. A fourth embodiment illustrates an audio player 10 including components that realize a control function. In this example, a user wears headphones 7, which are a device that is separate from the audio player 10. The audio player 10 may be a smartphone or a personal computer.

Figure 11:
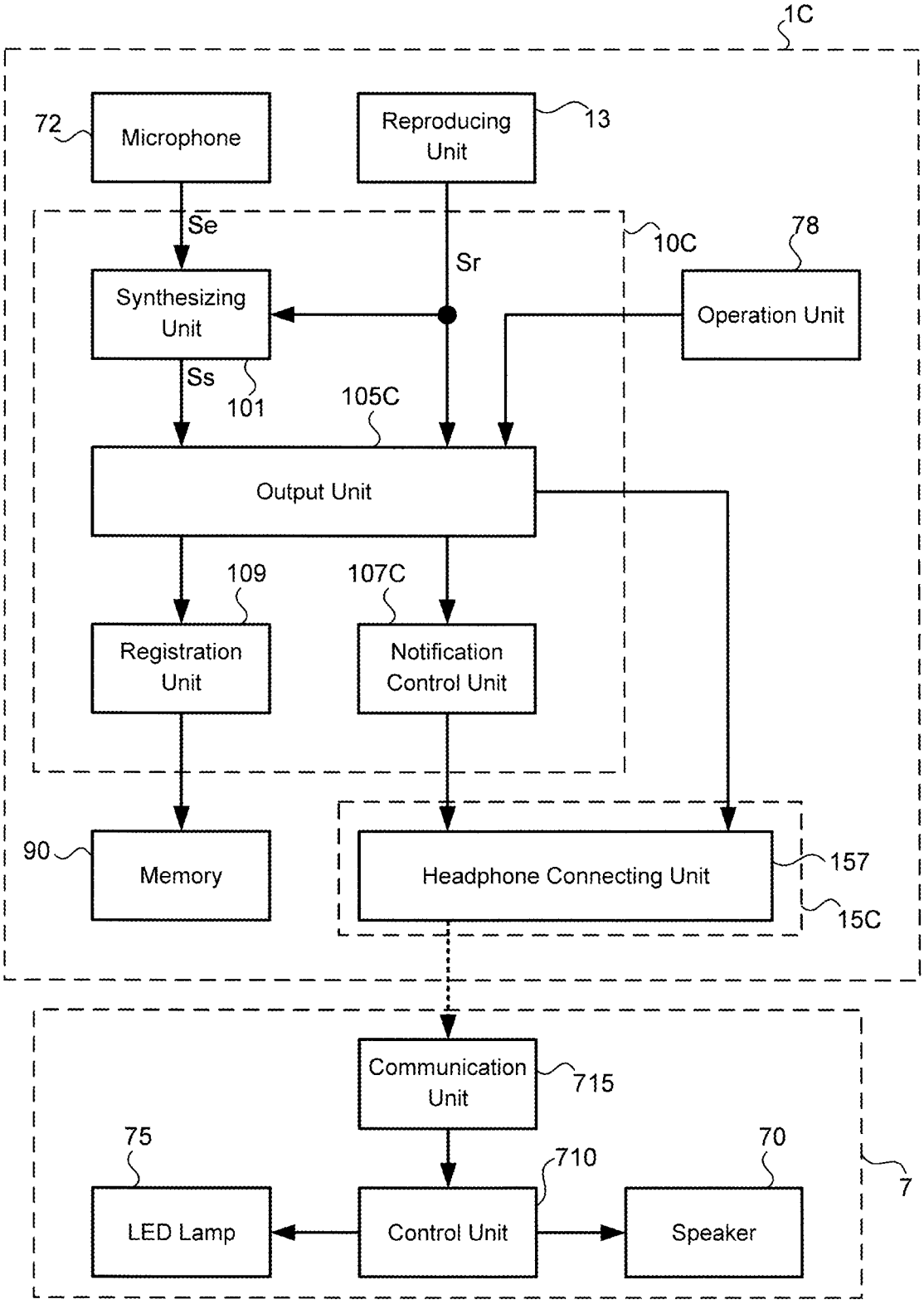
FIG. 11 is a diagram illustrating a configuration of a control function according to a fourth embodiment of the present disclosure.

FIG. 11 is a diagram illustrating a configuration of the control function according to the fourth embodiment of the present disclosure. The audio player 1C includes a control unit 100, a reproducing unit 13 (sound reproducing device), a communication unit 15C, the microphone 72, the operation unit 78, and the memory 90. The control unit 100 realizes the control function through the synthesizing unit 101, an output unit 105C, a notification control unit 107C, and the registration unit 109. The audio player 10 does not include the speaker 70 and the LED lamp 75 of the headphones 1 according to the first embodiment. These components are included in the headphones 7. The communication unit 15C functions as a headphone connecting unit 157 that is connected to the headphones 7. Other components given the same reference signs as those of the first embodiment have the same functions as those of the first embodiment.

The output unit 105C outputs either the reproduced sound signal Sr or the synthetic sound signal Ss to the headphone connecting unit 157. The notification control unit 107C outputs, to the headphone connecting unit 157, information (notification information) for controlling the LED lamp 75 in accordance with the selection information.

The headphones 7 are substantially identical in appearance configuration to the headphones 1 according to the first embodiment. The headphones 7 include the same speaker 70 and LED lamp 75 as those of the first embodiment and further include a control unit 710 and a communication unit 715. The communication unit 715 is a wireless communication module (e.g. short-range wireless communication such as Bluetooth (registered trademark)), and transmits and receives information to and from an external device under the control of the control unit 710. In this example, the communication unit 715 functions as a player connecting unit to which the audio player 1C is connected.

The control unit 710 includes an arithmetic processing circuit, such as a CPU, and a memory. The control unit 710 executes, through the CPU, a control program stored in the memory and causes the headphones 7 to realize various types of functions. The functions to be realized include an output function. According to the output function, a sound signal received by the communication unit 715 is outputted to the speaker 70, and the light-emitting state of the LED lamp 75 is controlled based on notification information received by the communication unit 715. In this example, as in the case of the first embodiment, the LED lamp 75 is in a light-emitting state when the synthetic sound signal Ss is outputted to the speaker 70, and is in a non-light-emitting state when the reproduced sound signal Sr is outputted to the speaker 70.

Fifth Embodiment

A fifth embodiment illustrates an example of a case where the audio player 1C according to the fourth embodiment is applied to a vehicle 1D such as an automobile.

Figure 12:
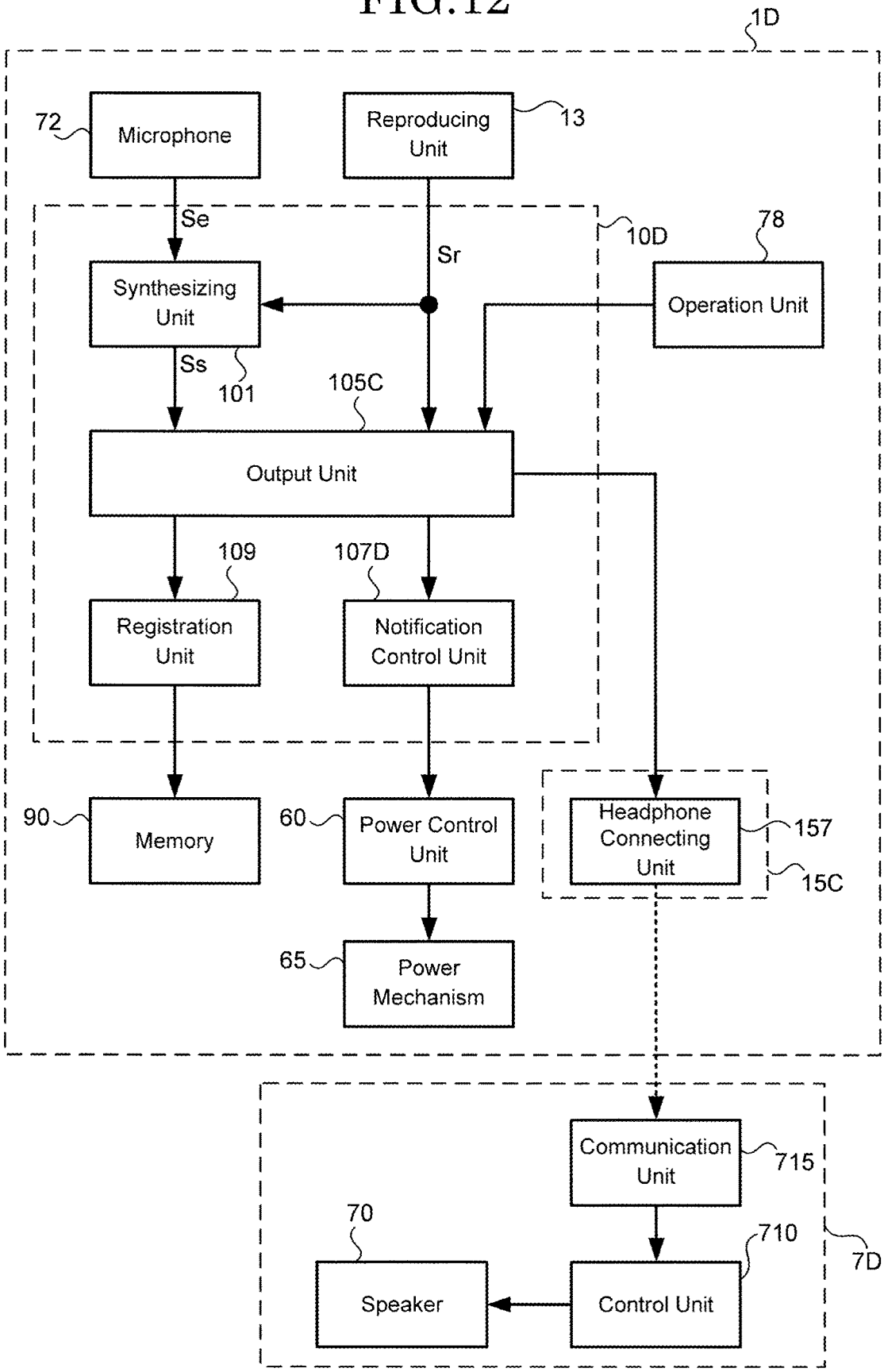
FIG. 12 is a diagram illustrating a configuration of a control function according to a fifth embodiment of the present disclosure.

FIG. 12 is a diagram illustrating a configuration of a control function according to the fifth embodiment of the present disclosure. The vehicle 1D includes a control unit 10D, the reproducing unit 13, the communication unit 15C, a power control unit 60, a power mechanism 65, the microphone 72, the operation unit 78, and the memory 90. The control unit 10D realizes the control function through the synthesizing unit 101, the output unit 105C, a notification control unit 107D, and the registration control unit 109. Headphones 7D include the speaker 70, a control unit 710D, and a communication unit 715. The headphones 7D do not include the LED lamp 75 of the headphones 7 according to the fourth embodiment. Other components given the same reference signs as those of the first and fourth embodiments have the same functions as those of the first and fourth embodiments. It is desirable that the microphone 72 be disposed so that sounds coming from outside the vehicle 1D can be inputted to the microphone 72.

The notification control unit 107D outputs, to the power control unit 60, information (notification information) for controlling the power mechanism 65 of the vehicle 1D in accordance with the selection information. The power mechanism 65 is a mechanism for moving the vehicle 1D and, for example, is a mechanism, such as an engine or a motor, that supplies power to drive the wheels. The power control unit 60 controls the power mechanism 65 of the vehicle 1D based on the notification information. In this example, when the output unit 105C is outputting the synthetic sound signal Ss to the speaker 70, i.e. during the synthetic sound mode, this control brings the vehicle 1D into a state where the vehicle 1D is allowed to move. On the other hand, when the output unit 105C is outputting the reproduced sound signal Sr to the speaker 70, i.e. during the reproduced sound mode, this control brings the vehicle 1D into a state where movement of the vehicle 1D is restricted. The state where movement of the vehicle 1D is restricted refers to a state where the power mechanism 65 restricts or shuts off the power to drive the wheels, e.g. where the engine is stopped or paths of transmission of the power between the engine and the wheels are shut off. According to such control, it can be said that whether the operation mode is the reproduced sound mode or the synthetic sound mode is notified to the outside depending on whether the vehicle 1D is allowed to move.

According to the vehicle 1D, which has such a control function, in a case in which the user drives the vehicle 1D while wearing the headphones 7D, the vehicle 1D cannot be put in motion when the operation mode is set to the reproduced sound mode, and the vehicle 1D can be put in motion when the operation mode is set to the synthetic sound mode. This improves the safety with which the vehicle 1D is driven. Disposing the microphone 72 so that sounds coming from outside the vehicle 1D can be inputted to the microphone 72 makes it easy for the user, who is in the vehicle 1D, to catch sounds coming from outside the vehicle 1D, thus further improving the safety.

Sixth Embodiment

In the fifth embodiment, the vehicle 1D can be put in motion when the operation mode is the synthetic sound mode. A sixth embodiment illustrates an example in which the operation mode is automatically switched to the synthetic sound mode when a vehicle 1E is put in motion.

Figure 13:
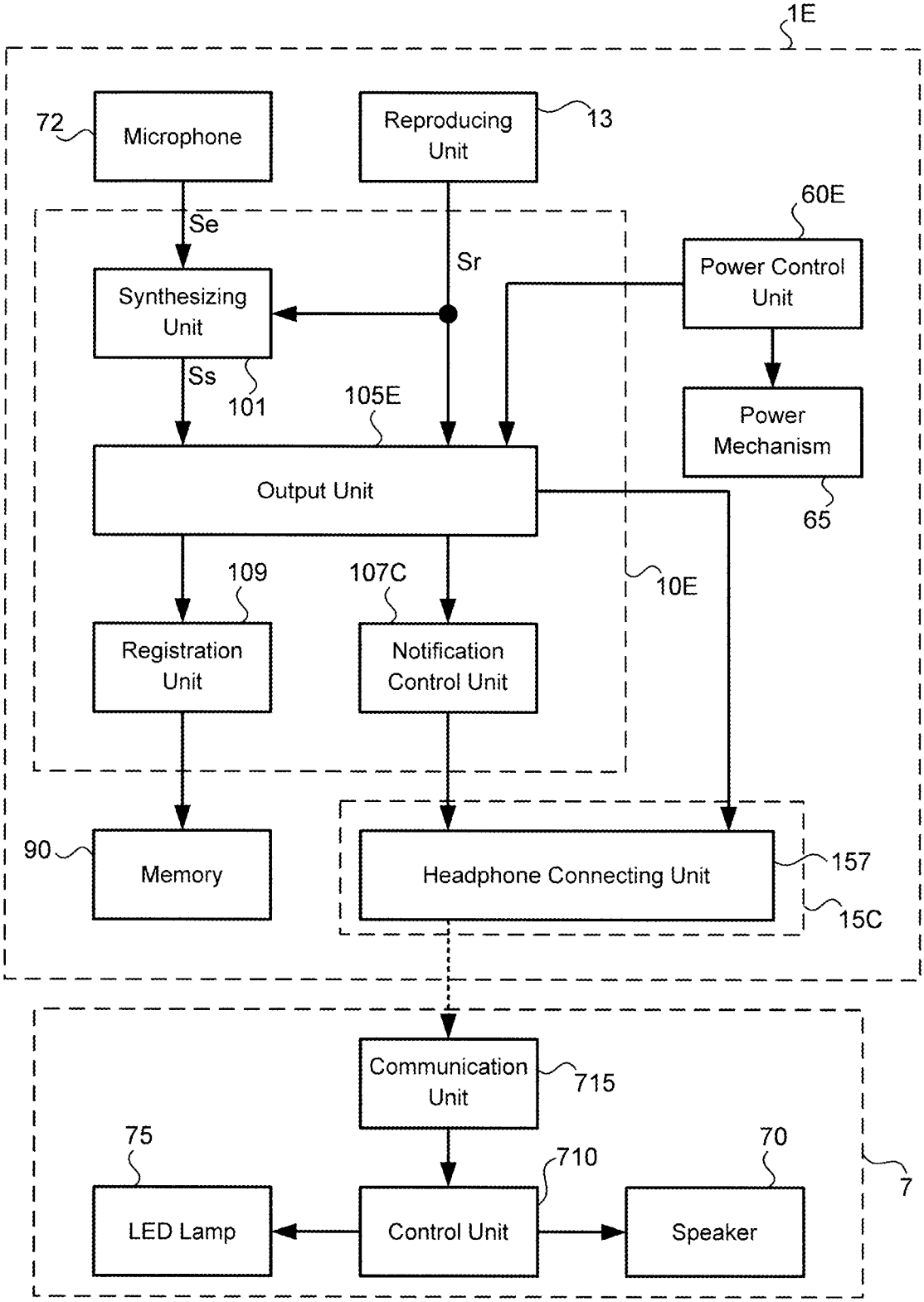
FIG. 13 is a diagram illustrating a configuration of a control function according to a sixth embodiment of the present disclosure.

FIG. 13 is a diagram illustrating a configuration of a control function according to the sixth embodiment of the present disclosure. The vehicle 1E includes a control unit 10E, the reproducing unit 13, the communication unit 15C, a power control unit 60E, the power mechanism 65, the microphone 72, the operation unit 78, and the memory 90. The control unit 10E realizes the control function through the synthesizing unit 101, an output unit 105E, the notification control unit 107C, and the registration control unit 109. The headphones 7 are identical in configuration to that of the fourth embodiment. Other components given the same reference signs as those of the first, fourth, and fifth embodiments have the same functions as those of the first, fourth, and fifth embodiments.

Upon a user's instruction (such as a key operation, an accelerator operation, or a brake operation), the power control unit 60E moves the vehicle 1E by controlling the power mechanism 65 in accordance with the instruction. On this occasion, the power control unit 60E outputs, to the output unit 105E, power control information corresponding to the contents of the control performed on the power mechanism 65. Based on the power control information, the output unit 105E selects either the reproduced sound signal Sr or the synthetic sound signal Ss and outputs the sound signal thus selected to the speaker 70. In this example, when the power control unit 60E is moving the vehicle 1E by controlling the power mechanism 65, the output unit 105E outputs the synthetic sound signal Ss to the speaker 70, and when the power control unit 60E is stopping the vehicle 1E by controlling the power mechanism 65, the output unit 105E outputs the reproduced sound signal Sr to the speaker 70.

According to the vehicle 1E, which has such a control function, in a case in which the user drives the vehicle 1E while wearing the headphones 7, the operation mode is automatically switched from the reproduced sound mode to the synthetic sound mode when the power mechanism 65 is controlled to move the vehicle 1E. This improves the safety with which the vehicle 1E is driven.

Seventh Embodiment

A seventh embodiment illustrates headphones 1F configured to effect a change in the light-emitting state of the LED lamp 75 depending on the proportion of the reproduced sound signal Sr and the external sound signal Se in the synthetic sound signal Ss.

Figure 14:
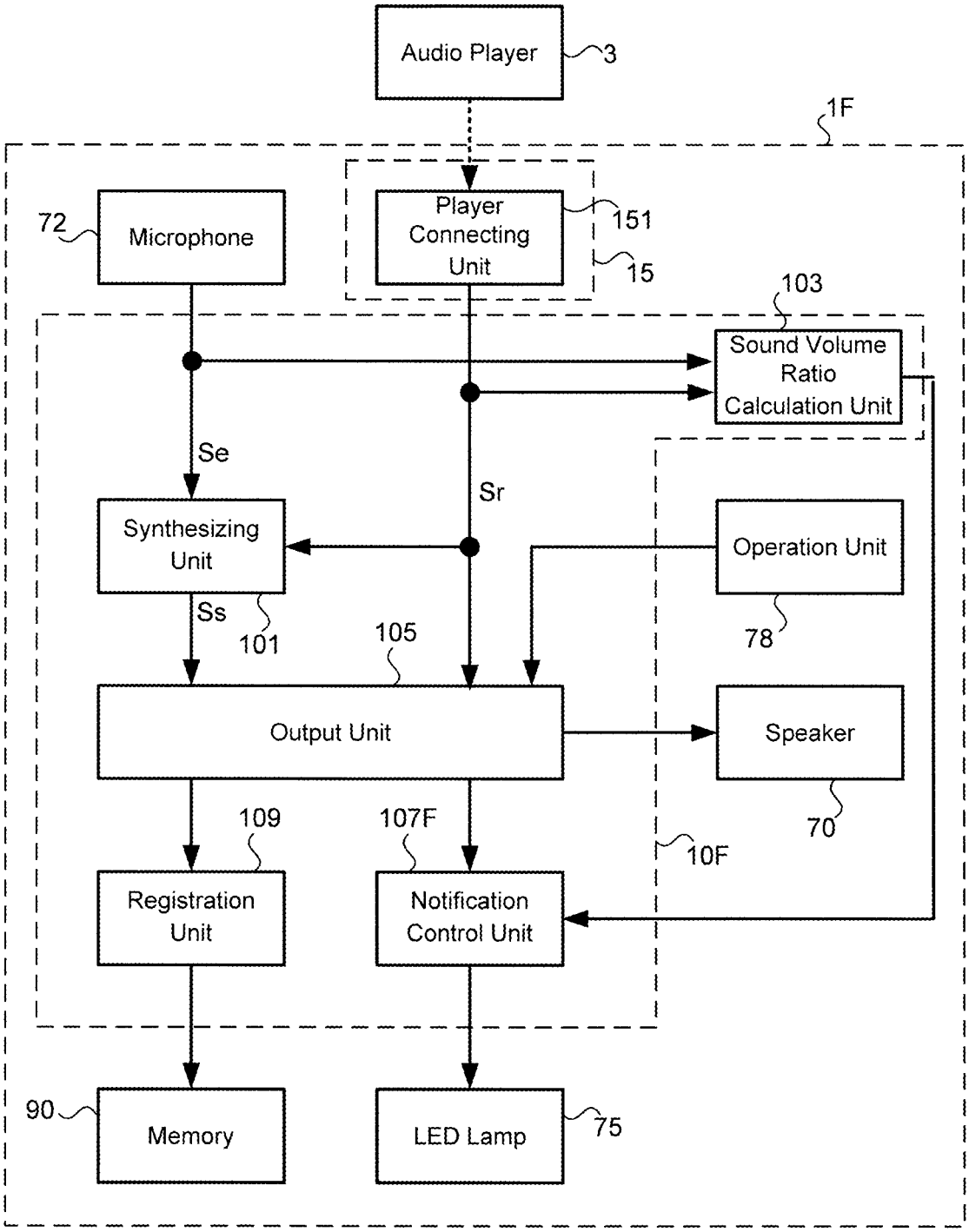
FIG. 14 is a diagram illustrating a configuration of a control function according to a seventh embodiment of the present disclosure.

FIG. 14 is a diagram illustrating a configuration of a control function according to the seventh embodiment of the present disclosure. The headphones 1F include a control unit 10F, the communication unit 15, the speaker 70, the microphone 72, the LED lamp 75, the operation unit 78, and the memory 90. The control unit 10F realizes the control function through the synthesizing unit 101, a sound volume ratio calculation unit 103, the output unit 105, a notification control unit 107F, and the registration unit 109. Other components given the same reference signs as those of the first embodiment have the same functions as those of the first embodiment. Accordingly, a description of those functions is omitted.

The sound volume ratio calculation unit 103 acquires the reproduced sound signal Sr and the external sound signal Se, calculates the signal proportion of the signal level of the reproduced sound signal Sr to the signal level of the external sound signal Se, and outputs the signal proportion to the notification control unit 107F. As in the case of the first embodiment, the notification control unit 107F controls the LED lamp 75 in accordance with selection information outputted from the output unit 105. In this example, the output unit 105 further controls the LED lamp 75 in accordance with the signal proportion outputted from the sound volume ratio calculation unit 103. In this example, when the synthetic sound signal Ss is being outputted to the speaker 70, i.e. during the synthetic sound mode, the notification control unit 107F controls the LED lamp 75 so that the LED lamp 75 is in a light-emitting state, and when the signal proportion has become equal to or larger than a predetermined value, the notification control unit 107F turns off the LED lamp 75 and controls the LED lamp 75 so that the LED lamp 75 is in a non-light-emitting state.

When the proportion of the signal level of the reproduced sound signal Sr to the signal level of the external sound signal Se increases during the synthetic sound mode, the proportion of the external sound signal Se in the synthetic sound signal Ss decreases, so that a situation substantially similar to the reproduced sound mode may arises where the user cannot listen to an external sound. For example, setting the audio player 10 to a higher sound volume level raises the signal level of the reproduced sound signal Sr. This makes it possible to create a situation substantially similar to the reproduced sound mode while setting to the synthetic sound mode. According to the headphones 1F, which have such a control function, when the proportion of the external sound signal Se in the synthetic sound signal Ss decreases, the LED lamp 75 can be controlled to be in a non-light-emitting state.

The sound volume ratio calculation unit 103 may output the signal proportion thus calculated to the synthesizing unit 101 instead of outputting it to the notification control unit 107F. In this case, the synthesizing unit 101 may perform addition of the external sound signal Se to the reproduced sound signal Sr after having adjusted the signal level of the reproduced sound signal Sr or the signal level of the external sound signal Se with reference to the signal proportion thus acquired so that the proportion of the signal level of the reproduced sound signal Sr to the signal level of the external sound signal Se does not become equal to or larger than the predetermined value.

Eighth Embodiment

In the first embodiment, the operation mode of the headphones 1 is notified to the outside by effecting a change in appearance of the headphones 1 depending on the light-emitting state of the LED lamp 75. Alternatively, such notification may be made to the outside by another method. An eighth embodiment illustrates an example in which a change in appearance of headphones is effected by a motion of a mechanical structure.

Figure 15:
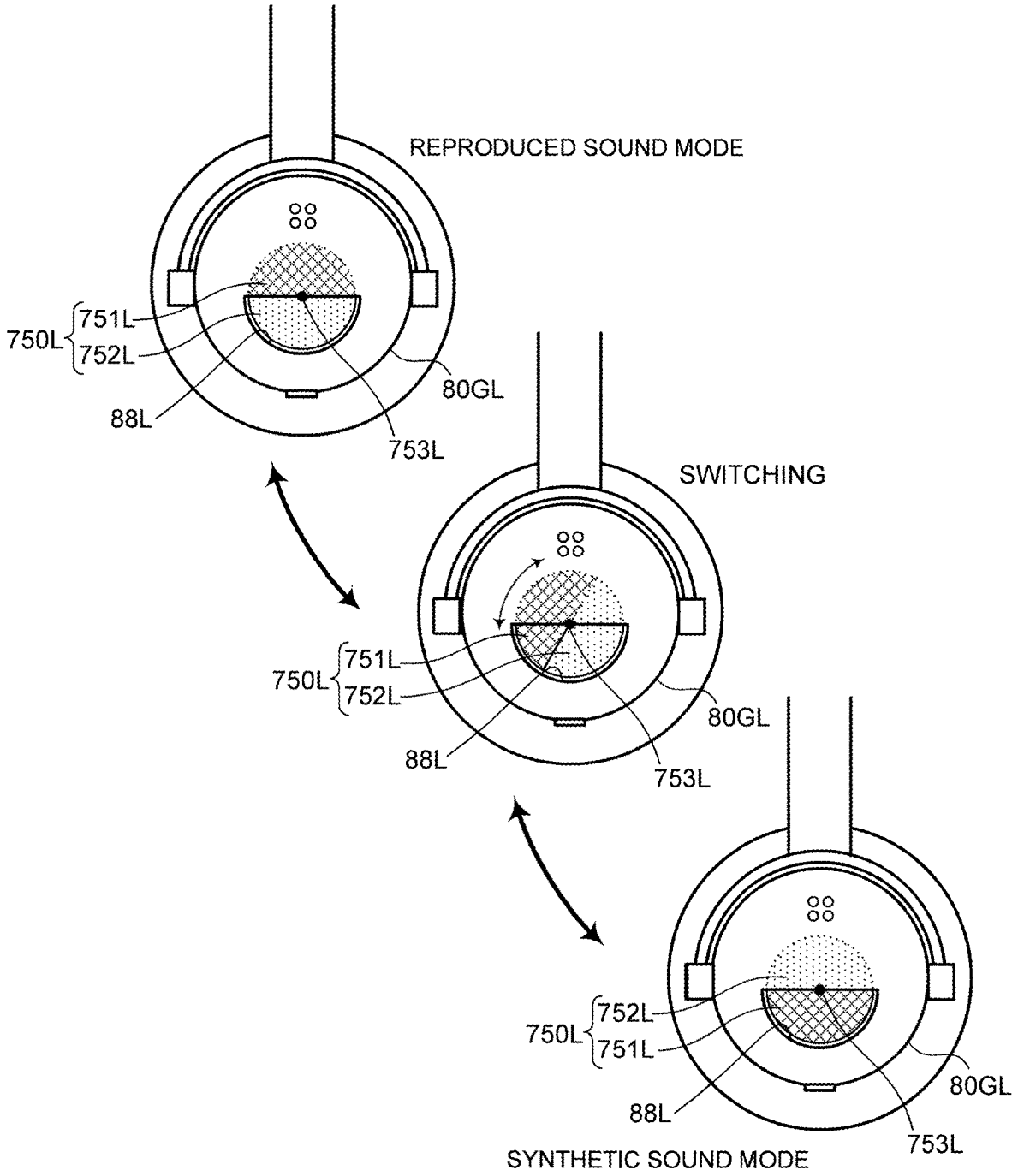
FIG. 15 is a diagram illustrating a change in appearance of headphones according to an eighth embodiment of the present disclosure.

FIG. 15 is a diagram illustrating a change in appearance of headphones according to the eighth embodiment of the present disclosure. As shown in FIG. 15, a left housing 80GL is provided with a semicircular opening 88L. The left housing 80GL houses a disk 750L inside so that a part of the disk 750L is exposed through the opening 88L. The disk 750L is attached to the left housing 80GL so as to be rotatable on a central axis 753L. The disk 750L is rotated, for example, by a motor.

The disk 750L is divided into two areas of different colors. These two areas are a first area 751L and a second area 752L. In this example, the first area 751L has a color which is greatly different from that of a surface of the left housing 80GL. The second area 752L has a color which is similar to or the same as that of the surface of the left housing 80GL.

In the first embodiment, during the reproduced sound mode, the LED lamp 75 is controlled to be in a non-light-emitting state, and during the synthetic sound mode, the LED lamp 75 is controlled to be in a light-emitting state. In the eighth embodiment, an area on the disk 750L exposed through the opening 88L is controlled to vary depending on the operation mode. In this example, the position of the disk 750L in the direction of rotation is controlled so that the second area 752L is exposed through the opening 88L during the reproduced sound mode and the first area 751L is exposed through the opening 88L during the synthetic sound mode.

The mechanical structure for notifying the operation mode to the outside is not limited to the aforementioned configuration but may be configured in various ways. That is, the mechanical structure needs only be a structure whose position changes upon switching of the operation mode. On this occasion, it is desirable that the mechanical structure be in an externally viewable place when a user is wearing the headphones over user's ears and be more externally visually conspicuous during the synthetic sound mode than during the reproduced sound mode.

Ninth Embodiment

In the eighth embodiment, the operation mode to the outside is notified by a change effected in appearance of the headphones by a motion of the mechanical structure. A ninth embodiment illustrates an example in which this mechanical structure can be moved by a used and is used also as an operation unit.

Figure 16:
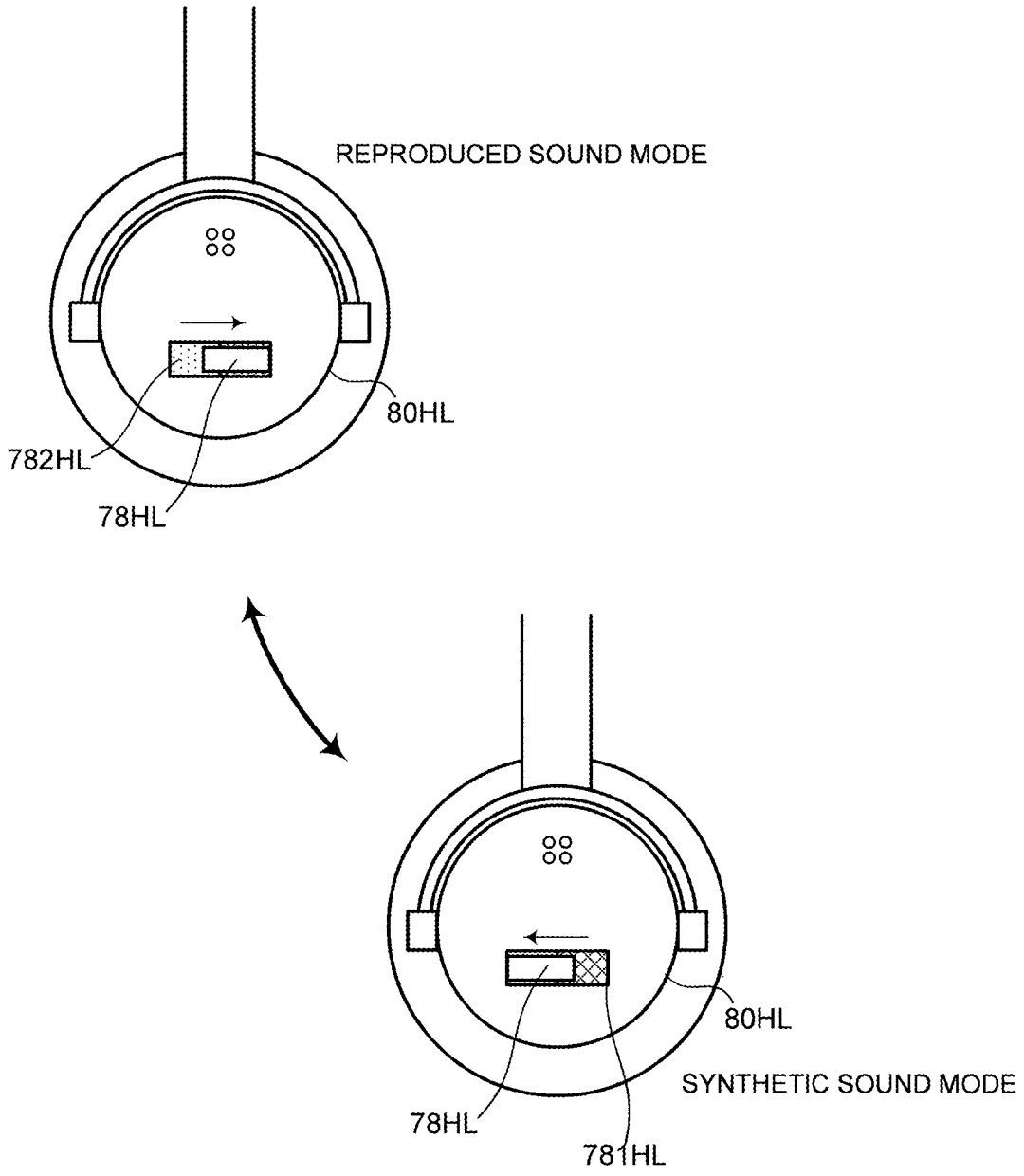
FIG. 16 is a diagram illustrating a change in appearance of headphones according to a ninth embodiment of the present disclosure.

FIG. 16 is a diagram illustrating a change in appearance of headphones according to the ninth embodiment of the present disclosure. As shown in FIG. 16, a left housing 80HL houses a switch 78HL that can be moved by sliding. The switch 78HL can move within a range divided into two areas of different colors. These two areas are a first area 781 HL and a second area 782HL. In this example, the first area 781HL has a color which is greatly different from that of a surface of the left housing 80HL. The second area 782HL has a color which is similar to or the same as that of the surface of the left housing 80HL.

In this example, the reproduced sound mode is set when the switch 78HL is moved (rightward in the illustration) so that the second area 782HL is exposed. On the other hand, the synthetic sound mode is set when the switch 78HL is moved (leftward in the illustration) so that the first area 781HL is exposed. Thus, in the ninth embodiment, too, the operation mode can be notified to the outside by effecting a change in appearance of the headphones.

Modifications

The above-described embodiments of the present disclosure can be modified into various modifications described below. Further, the above-described embodiments and the modification described below can be applied in combination with each other.

(1) Although the description has been given with reference to examples in which headphones are worn over the ears of a user, the headphones may be replaced by earphones as a device that is worn over the ears of a user. In the case of earphones, housings per se or earpieces may serve as a wearable component (wearing unit) with which for a user to wear the earphones over user's ears. In the case of headphones separated into right and left components without a headband, hooks or the like need only be used so that the housings 80 can be worn over the ears of a user. Further, headphones may be configured to include right and left components attached to a helmet or the like. In this case, it is only necessary to dispose the speaker 70 so that the speaker 70 emits a sound toward the inside of the helmet, dispose the LED lamp 75 so that the LED lamp 75 emits light toward the outside of the helmet, and dispose the microphone 72 so that sounds coming from outside the helmet can be inputted to the microphone 72. In this way, the LED lamp 75 needs only be disposed at a side opposite to the speaker 70 across the wearing unit.

(2) While the LED lamp 75 is in a light-emitting state during the synthetic sound mode, the LED lamp 75 may be turned on at a timing that is later than the point of time t1 and may be turned off at a timing that is earlier than the point of time t2. When the LED lamp 75 is turned off at a timing that is earlier than the point of time t2, the notification control unit 107, by using not a selection signal but an operation signal, can turn off the LED lamp 75 before the output signal to the speaker 70 is switched from the synthetic sound signal Ss to the reproduced sound signal Sr.

(3) The period information to be registered in the memory 90 may be indicated by the point of time t1 and a duration time (duration time during which the synthetic sound signal Ss was being outputted) having elapsed since the point of time t1, or may be indicated by the point of time t2 and a duration time (duration time during which the synthetic sound signal Ss was being outputted) that elapses until the point of time t2. Further, while information indicating that the synthetic sound signal Ss is being outputted to the speaker 70 at the point of time t1 is registered in the memory 90, the information may be deleted at the point of time t2.

(4) While the right and left microphones 72 (72R and 72L) are provided so that the external sound signal Se is incorporated into the synthetic sound signal Ss and ultimately supplied as a stereo signal to the speakers 70 (70L and 70R), the external sound signal Se may be a monophonic signal. In this case, either the right or left microphone 72 needs only be provided.

(5) The memory 90 does not need to be used. In this case, the registration unit 109 is not needed to realize the control function. Further, in the case of the vehicles 1D and 1E, as in the case of the fifth and sixth embodiments, the memory 90 may be used also as a memory, such as an event data recorder, in which behavior information associated with the behavior of the vehicle is registered. In this case, the registration unit 109 registers the period information in such a memory. On this occasion, the behavior information may be associated with other behavior information.

(6) The synthesizing unit 101 may further produce a second synthesized signal by inverting the phase of the external sound signal Se and adding the external sound signal Se to the reproduced sound signal Sr. When outputted to the speaker 70, this second synthesized signal can also be used as a so-called noise-canceling function. In this case, a noise-canceling mode needs only be added to the operation modes among which switching can be made.

(7) The synthesizing unit 101 outputs a sound synthesized by adding together the reproduced sound signal Sr and the external sound signal Se. On this occasion, another processing may be involved. For example, a frequency component of the external sound signal Se may be subtracted from the reproduced sound signal Sr by executing, prior to this addition, a processing (so-called spectral subtraction technique) of subtracting the external sound signal Se from the reproduced sound signal Sr in a frequency domain. In a case where the reproduced sound signal Sr and the external sound signal Se are opposite in phase to each other at a certain frequency, simply adding them together may cause a reversed-phase component to be attenuated and make it hard to catch the external sound out of the synthetic sound. Meanwhile, executing such a spectral subtraction technique in advance can make the external sound clear out of the synthetic sound even if such a reversed-phase component is contained.

REFERENCE SIGNS LIST

1, 1A, 1B, 1F, 7, 7D . . . headphones, 1C, 3 . . . audio player, 1D, 1E . . . vehicle, 5 . . . notification terminal, 10, 10A, 10B, 10C, 10D, 10E, 10F . . . control unit, 13 . . . reproducing unit, 15, 15A, 15C . . . communication unit, 50 . . . control unit, 55 . . . communication unit, 57 . . . display unit, 58 . . . operation unit, 60, 60E . . . power control unit, 65 . . . power mechanism, 70 . . . speaker, 72 . . . microphone, 75 . . . LED lamp, 78 . . . operation unit, 78HL . . . switch, 79 . . . sensor, 80 . . . housing, 80GL, 80HL . . . left housing, 82 . . . earmuff, 85 . . . headband, 88L . . . opening, 90 . . . memory, 99 . . . power supply, 101 . . . synthesizing unit, 103 . . . sound volume ratio calculation unit, 105, 105B, 105C, 105E . . . output unit, 107, 107A, 107C, 107D, 107F . . . notification control unit, 109 . . . registration unit, 151 . . . player connecting unit, 155 . . . notification terminal connecting unit, 157 . . . headphone connecting unit, 710, 710D . . .

control unit, 715 . . . communication unit, 750L . . . disk, 751L . . . first region, 752L . . . second region, 753L . . . central axis, 781HL . . . first region, 782HL . . . second region

What is claimed is:

1. A sound control device comprising:

a first memory storing instructions; and a processor that implements the stored instructions to execute a plurality of instructions, including:

a synthesizing task that synthesizes a synthesized sound signal from an input sound signal acquired from a sound input device and a reproducing sound signal acquired from a sound reproducing device;

an outputting task that outputs alternately between the reproducing sound signal and the synthesized sound signal to a sound emitting device;

a notification control task that outputs notifying information for causing a notifying device to notify for a notification period, which is an output period during which the outputting task is outputting the synthesized sound signal to the sound emitting device; and a registering task that registers, in a second memory, duration information specifying the notification period.

2. The sound control device according to claim 1, wherein the registered duration information includes a duration time elapsing from when the output task starts and ends outputting the synthesized sound signal.

3. The sound control device according to claim 1, wherein the registered duration information includes time information indicating the output period of the synthesized sound signal.

4. The sound control device according to claim 1, further comprising:

a sensor that detects a position of the control device, wherein the output task, based on the position detected by the sensor, switches alternately between outputting the reproducing sound signal to the sound emitting device and outputting the synthesized sound signal to the sound emitting device.

5. The sound control device according to claim 1, further comprising:

a sensor that detects behavior of the control device, wherein the output task, based on the behavior detected by the sensor, switches alternately between outputting the reproducing sound signal to the sound emitting device and outputting the synthesized sound signal to the sound emitting device.

6. A wearable sound device comprising:

a wearable component configured to be worn over an ear and including a sound emitting device;

a notifying device disposed in an externally viewable place in a state where the wearable component is held over the ear;

a first memory storing instructions; and a processor that implements the stored instructions to execute a plurality of tasks, including:

a synthesizing task that synthesizes a synthesized sound signal from an input sound signal acquired from a sound input device and a reproducing sound signal acquired from a sound reproducing device;

an outputting task that outputs alternately between the reproducing sound signal and the synthesized sound signal to the sound emitting device;

a notification control task that outputs notifying information for causing the notifying device to notify for a notification period, which is an output period during which the outputting task is outputting the synthesized sound signal to the sound emitting device; and a registering task that registers, in a second memory, duration information specifying the notification period.

7. The wearable sound device according to claim 6, wherein:

the wearable component includes the notifying device, and the notifying device is disposed at a side opposite to the sound emitting device.

8. The wearable sound device according to claim 7, wherein the notification control task causes the notifying device to notify in different forms depending on a proportion of a signal level of the reproducing sound signal to a signal level of the input sound signal of the synthesized sound signal.

9. The wearable sound device according to claim 6, wherein the notifying device is an LED lamp that emits light.

10. A control method of controlling a sound control device, the method comprising:

outputting a reproducing sound signal acquired from a sound reproducing device to a sound emitting device;

switching outputting of the reproducing sound signal to the sound emitting device to outputting a synthesized sound signal to the sound emitting device, the synthesized sound signal being synthesized from an input sound signal acquired from a sound input device and the reproducing sound signal;

outputting notifying information for causing a notifying device to notify for a notification period, which is an output period during which the synthesized sound signal is output to the sound emitting device; and registering, in a second memory, duration information specifying the notification period.

11. The control method according to claim 10, wherein the registered duration information includes a duration time elapsing from when the outputting starts and ends outputting the synthesized sound signal.

12. The control method according to claim 10, wherein the registered duration information includes time information indicating the output period of the synthesized sound signal.

13. The control method according to claim 10, further comprising:

detecting, using a sensor, a position of the sound control device, wherein the switching, based on the detected position, switching alternately between outputting the reproducing sound signal to the sound emitting device and outputting the synthesized sound signal to the sound emitting device.

14. The control method according to claim 10, further comprising:

detecting, using a sensor, behavior of the sound control device, wherein the switching, based on the detected behavior, switching alternately between outputting the reproducing sound signal to the sound emitting device and the synthesized sound signal to the sound emitting device.

* * * * *